US006541922B2

(12) United States Patent
Shirozu

(10) Patent No.: US 6,541,922 B2
(45) Date of Patent: Apr. 1, 2003

(54) ALTERNATING CURRENT DRIVEN TYPE PLASMA DISPLAY DEVICE AND METHOD FOR THE PRODUCTION THEREOF

(75) Inventor: Shinichiro Shirozu, Tokyo (JP)

(73) Assignee: Sony Corporation (JP)

( * ) Notice: Subject to any disclaimer, the term of this patent is extended or adjusted under 35 U.S.C. 154(b) by 140 days.

(21) Appl. No.: 09/750,119

(22) Filed: Dec. 29, 2000

(65) Prior Publication Data

US 2001/0006326 A1 Jul. 5, 2001

(30) Foreign Application Priority Data

Jan. 5, 2000 (JP) ..... 2000-000226

(51) Int. Cl.[7] ..... G09G 3/10; H01J 17/49

(52) U.S. Cl. ..... 315/169.4; 313/582

(58) Field of Search ..... 315/169.3, 169.4, 315/584; 313/582, 483, 485, 486; 345/55, 60, 76

(56) References Cited

U.S. PATENT DOCUMENTS 3,538,371 A 11/1970 Lehrer
4,853,590 A 8/1989 Andreadakis ..... 313/485
5,949,188 A * 9/1999 Leising et al. ..... 313/500
5,967,872 A * 10/1999 Betsui et al. ..... 445/24
6,117,529 A * 9/2000 Leising et al. ..... 257/88
6,144,153 A * 11/2000 Nakatani ..... 313/292
6,195,074 B1 * 2/2001 Kim ..... 315/169.4
6,313,894 B1 * 11/2001 Sekine et al. ..... 349/88

FOREIGN PATENT DOCUMENTS

EP 0975001 A2 1/2000
JP 11-317172 11/1999

* cited by examiner

*Primary Examiner*—Don Wong
*Assistant Examiner*—Minh D A
(74) *Attorney, Agent, or Firm*—Rader, Fishman & Grauer PLLC; Ronald P. Kananen, Esq.

(57) ABSTRACT

An alternating current driven type plasma display device having (a) a first panel comprising a first substrate; a first electrode group constituted of a plurality of first electrodes formed on the first substrate and a protective layer formed on the first electrode group and on the first substrate and (b) a second panel comprising a second substrate fluorescence layers formed on or above the second substrate; and separation walls which extend in the direction making a predetermined angle with the extending direction of the first electrodes and each of which is formed between one fluorescence layer and another neighboring fluorescence layer, wherein discharge is caused between each pair of the first electrodes facing each other, and a recess is formed in the first substrate between each pair of the facing first electrodes.

13 Claims, 19 Drawing Sheets

[STEP-120]

[STEP-100]

[STEP-100] CONTINUED

[STEP-100] CONTINUED

[STEP-110]

[STEP-110] CONTINUED

[STEP-200]

[STEP-210]

[STEP-210] CONTINUED

[STEP-210] CONTINUED

[STEP-220]

[STEP-300]

[STEP-310]

[STEP-310] CONTINUED (PRESENT INVENTION)

(PRESENT INVENTION)

(PRESENT INVENTION)

(PRESENT INVENTION)

ALTERNATING CURRENT DRIVEN TYPE PLASMA DISPLAY DEVICE AND METHOD FOR THE PRODUCTION THEREOF

BACKGROUND OF THE INVENTION AND RELATED ART STATEMENT

The present invention relates to an alternating current driven type plasma display device and a method for the production thereof.

As an image display device that can be substituted for a currently mainstream cathode ray tube (CRT), flat-screen (flat-panel) display devices are studied in various ways. Such fat-panel display devices include a liquid crystal display (LCD), an electroluminescence display (ELD) and a plasma display device (PDP). Of these, the plasma display device has advantages that it is relatively easy to form a larger screen and attain a wider viewing angle, it has excellent durability against environmental factors such as temperatures, magnetism, vibrations, etc., and it has a long lifetime. The plasma display device is therefore expected to be applicable not only to a home-use, wall-hung television set but also to a large-sized public information terminal.

In the plasma display device, a voltage is applied to discharge cells charged with a rare gas, and a fluorescence layer in each discharge cell is excited with vacuum ultraviolet ray generated by glow discharge in the rare gas to give light emission. That is, each discharge cell is driven according to a principle similar to that of a fluorescent lamp, and generally, the discharge cells are put together on the order of hundreds of thousands to constitute a display screen. The plasma display device is largely classified into a direct-current driven type (DC type) and an alternate-current driven type (AC type) according to the methods of applying a voltage to the discharge cells, and each type has advantages and disadvantages. The AC type plasma display device is suitable for attaining a higher fineness, since separation walls which work to separate the discharge cells within a display screen can be formed, for example, in the form of stripes. Further, it has an advantage that electrodes are less worn out and have a long lifetime, since the surfaces of the electrodes are covered with a dielectric material.

FIG. 2 shows a typical constitution of a conventional AC type plasma display device. This AC type plasma display device comes under a so-called tri-electrode type, and discharging takes place mainly between the first electrodes 12A and 12B, which are a pair of discharge sustain electrodes (see FIG. 12B). In the AC type plasma display device shown in FIG. 2, a front panel 10 and a rear panel 20 are bonded to each other in their circumferential portions. Light emission from fluorescence layers 24 on the rear panel is viewed through the front panel 10.

The front panel 10 comprises a transparent first substrate 11, pairs of first electrodes 12A and 12B composed of a transparent, electrically conductive material and formed on the first substrate 11 in the form of stripes, bus electrodes 13 composed of a material having a lower electric resistivity than the first electrodes 12A and 12B and provided for decreasing the impedance of the first electrode 12A and 12B, and a protective layer 14 formed on the first substrate 11, the first electrodes 12A and 12B and bus electrodes 13. The protective layer 14 works as a dielectric film and is provided for protecting the first electrodes 12A and 12B.

The rear panel 20 comprises a second substrate 21, second electrodes (also called address electrodes or data electrodes) 22 formed on the second substrate 21 in the form of stripes, a dielectric film 23 formed on the second substrate 21 and on the second electrodes 22, insulating separation walls 25, which are formed in regions on the dielectric film 23 between neighboring second electrodes 22 and which extend in parallel with the second electrodes 22, and fluorescence layers 24 which are formed on, and extend from, the surfaces of the dielectric film 23 and which also are formed on side walls of the separation walls 25. The second electrodes 22 are provided for decreasing a discharge starting voltage. The separation walls 25 are provided for preventing an optical crosstalk, a phenomenon in which plasma discharge leaks to a neighboring discharge cell and allows a fluorescence layer of the neighboring discharge cell to emit light. Each fluorescence layer 24 is constituted of a red fluorescence layer 24R, a green fluorescence layer 24G and a blue fluorescence layer 24B, and the fluorescence layers 24R, 24G and 24B of these colors are formed in a predetermined order. FIG. 2 is an exploded perspective view, and in an actual embodiment, top portions of the separation walls 25 on the rear panel side are in contact with the protective layer 14 on the front panel side. A region where a pair of the first electrodes 12A and 12B and a pair of the separation walls 25 overlap corresponds to one discharge cell. A rare gas is sealed in each space surrounded by two neighboring separation walls 25, the fluorescence layers 24 and the protective layer 14.

The extending direction of the first electrodes 12A and 12B and the extending direction of the second electrodes 22 make an angle of 90°, and the region where a pair of the neighboring first electrodes 12A and 12B and one set of the fluorescence layers 24R, 24G and 24B for emitting light of three primary colors overlap corresponds to one pixel. Glow discharge takes place between the pair of the facing first electrodes 12A and 12B, so that a plasma display device of this type is called "surface discharge type". In each discharge cell, the fluorescence layers excited by irradiation with vacuum ultraviolet ray generated by glow discharge in the rare gas emit light of colors characteristic of kinds of fluorescent materials. A vacuum ultraviolet ray having a wavelength depending upon the kind of the sealed rare gas is generated.

FIG. 19 shows a schematic layout of a pair of the first electrodes 12A and 12B, the bus electrode 13 and the separation walls 25 in the conventional plasma display device shown in FIG. 2. The region surrounded by dotted lines corresponds to one pixel. For clarification of each region, slanting lines are added. In general, each pixel has the form of a square. Each pixel is divided into three sections (discharge cells) with the separation walls 25, and each section emits light of one of three primary colors (R, G, B). When one pixel has an outer dimension $L_0$, one side of each discharge cell has a length of $L_0/3=L_1$, and the other side has a length of $L_0$. In a pair of the first electrodes 12A and 12B, therefore, those portions of the first electrodes 12A and 12B that contribute to discharging have a length slightly smaller than $L_1$ each.

Meanwhile, in the plasma display device, it is increasingly demanded to increase the density and fineness of pixels. For complying with such demands, it is inevitable to decrease the length $L_1$ of one side of each discharge cell. Suppose a case where one discharge cell having a side length $L_1$ as shown in a conceptual view of FIG. 16A, is modified to a discharge cell having a side length $L_1/2=L_2$ as shown in a conceptual view of FIG. 16B. In this connection, a subscript "1" is added when the state shown in FIG. 16A is explained, and a subscript "2" is added when the state shown in FIG. 16B is explained. In the above case, the thickness of each separation wall 25 is changed from $W_1$ to $W_2$. Since, however, the separation walls 25 are required to have certain strength for preventing failures, such as chipping during the formation of the separation walls, it involves some difficulty that the value of $W_2$ equals ½ of $W_1$. Therefore, a discharge space interposed between the separation walls 25 has a volume $V_2$ which is less than ½ of a volume $V_1$ of an original discharge space.

As the volume of the discharge cell decreases as described above, the number of metastable particles (the rare gas atoms, molecules, dimers, etc., in a metastable state in the discharge space) required for starting and sustaining discharge decreases, which results in an increase in the discharge starting voltage or discharge sustaining voltage and causes a decrease in efficiency. Further, the distance between a pair of the facing first electrodes 12A and 12B decreases, and as a result, leak current is liable to flow and dielectric breakdown or abnormal discharge is liable to take place. Furthermore, since it is required to decrease the thickness of each of the separation walls 25, the separation walls 25 are liable to be damaged during fabrication. The damage on the separation walls 25 may cause an optical crosstalk.

The light emission process in the plasma display device is as follows: the protective layer 14 near one first electrode of a pair of the facing first electrodes 12A and 12B, corresponding to a cathode electrode, is hit with ions to allow the protective layer 14 to release secondary electrons, neutral gas is ionized by accelerating the secondary electrons to increase the number electrons, these electrons excite the rare gas, and as a result, the fluorescence layer is excited by radiated vacuum ultraviolet ray to emit visible light. When the distance between the separation walls 25 decreases, the secondary electrons released from the protective layer 14 are liable to adhere to the separation walls 25, which causes a decrease in efficiency.

OBJECT AND SUMMARY OF THE INVENTION

It is, therefore, an object of the present invention to provide a plasma display device that can achieve efficient light emission, causes no increase in discharge starting voltage and discharge sustain voltage and is almost free of dielectric breakdown and abnormal discharge, even if the distance between the separation walls are decreased for realizing higher-density pixels and higher fineness, and a method for the production thereof.

The alternating current driven type plasma display device of the present invention for achieving the above object is an alternating current driven type plasma display device having;

(a) a first panel comprising a first substrate; a first electrode group constituted of a plurality of first electrodes formed on the first substrate, and a protective layer formed on the first electrode group and on the first substrate, and (b) a second panel comprising a second substrate, fluorescence layers formed on or above the second substrate, and separation walls which extend in the direction making a predetermined angle with the extending direction of the first electrodes and each of which is formed between one fluorescence layer and another neighboring fluorescence layer, wherein discharge is caused between each pair of the first electrodes facing each other, and a recess is formed in the first substrate between each pair of the facing first electrodes.

The alternating current driven type plasma display device of the present invention has a structure in which the first panel and the second panel are disposed such that the protective layer faces the fluorescence layers, the extending direction of the first electrodes and the extending direction of the separation walls make a predetermined angle (for example, 90°), each space surrounded by the protective layer, the fluorescence layer and a pair of the separation walls is charged with a rare gas, and the fluorescence layer emits light when irradiated with vacuum ultraviolet ray generated by alternate current glow discharge in the rare gas caused between a pair of the facing first electrodes. The region where a pair of the first electrodes and a pair of the separation walls overlap corresponds to one discharge cell.

In the plasma display device of the present invention or a method for the production thereof (described later) provided by the present invention, the recess can be a trench, and in this case, the spatial width of the trench is less than $5\times10^{-5}$ m, preferably $4\times10^{-5}$ m or less, and more preferably $2.5\times10^{-5}$ m or less. The minimum value of the spatial width of the trench can be a value at which no dielectric breakdown takes place in the trench. When the extending direction of the trench is taken as the X-axis and the normal line direction of the first substrate is taken as the Z-axis, the "spatial width of the trench" refers to a spatial distance of the trench in the Y-direction. When the protective layer is not formed on the side walls or the bottom of the trench, it means a distance between the facing side walls of the trench. When the protective layer is formed on the side walls and the bottom of the trench, it means a distance between the surfaces of the protective layer on the facing side walls of the trench along the Y-axis. When the width of the trench varies in the Z-axis direction, the spatial width of the trench in the broadest portion of the trench is taken as a spatial width of the trench. While the depth of the trench is not essentially limited, it is preferably approximately 0.5 to 5 times the spatial width of the trench.

Alternatively, in the plasma display device of the present invention or a method for the production thereof, provided by the present invention, the recess can be a blind hole formed in a region of the first substrate positioned between each pair of the separation walls. In this case, the spatial diameter of the blind hole is less than $5\times10^{-5}$ m, preferably $4\times10^{-5}$ m or less, and more preferably $2.5\times10^{-5}$ m or less. The minimum value of the spatial diameter of the blind hole can be a value at which no dielectric breakdown takes place in the blind hole. When the cross-sectional form obtained by cutting the blind hole with an imaginary plane (XY plane) at right angles with the normal line direction (Z-axis direction) of the first substrate is other than a rectangular form, the "spatial diameter of the blind hole" refers to the diameter of a circle having an area equal to the cross-sectional area of such a blind hole. When the protective layer is formed on the side wall and the bottom of the blind hole having the above cross-sectional form, the "spatial diameter of the blind hole" refers to the diameter of a circle having the area equal to an area of a form of the locus drawn by the surface of the protective layer obtained by cutting the blind hole with the XY plane. When the cross-sectional form is rectangular, it refers to the length of the side in parallel with the extending direction (Y-direction) of a pair of the separation walls. When the protective layer is formed on the side walls and the bottom of the above rectangular blind hole, the spatial diameter of the blind hole refers to a distance between facing surfaces of the protective layer along the direction in parallel with the extending direction (Y-axis direction) of a pair of the separation walls. When the cross-sectional area of the blind hole varies in the Z-axis direction, the spatial diameter of the blind hole on the basis of the largest cross-sectional area is taken as a spatial diameter of the blind hole. Specific examples of the cross-sectional form of the blind hole include a circle, an oval, and any polygons including rectangular forms such as a square and a rectangle and rounded polygons. Although essentially not limited, the depth of the blind hole is preferably approximately 0.5 to 5 times the spatial diameter of the blind hole. In some cases, the blind hole may extend to a portion of the first substrate below the separation walls.

The method for the production of an alternating current driven type plasma display device according to any one of the first to third aspects of the present invention to be explained hereinafter is a method for the production of the alternating current driven type plasma display device of the present invention, that is, an alternating current driven type plasma display device having (a) a first panel comprising a first substrate; a first electrode group constituted of a plurality of first electrodes formed on the first substrate; and a protective layer formed on the first electrode group and on the first substrate, and (b) a second panel comprising a second substrate; fluorescence layers formed on or above the second substrate; and separation walls which extend in the direction making a predetermined angle with the extending direction of the first electrodes and each of which is formed between one fluorescence layer and another neighboring fluorescence layer, wherein discharge is caused between each pair of the first electrodes facing each other.

The method for the production of an alternating current driven type plasma display device according to the first aspect of the present invention for achieving the above object includes the steps of;

(A) forming the patterned first electrodes on the first substrate, (B) forming a recess in the first substrate between each pair of the first electrodes facing each other, and (C) forming the protective layer on the first electrode group and on the first substrate including the inside of each recess, to fabricate the first panel.

In the method for the production of an alternating current driven type plasma display device according to the first aspect of the present invention, step (B) can comprise the steps of forming a resist layer having an opening portion between a pair of the facing first electrodes on the entire surface, and then, etching (wet-etching or dry-etching) the first substrate by using the resist layer as an etching mask, whereby the recess constituted of a trench or a blind hole can be obtained. Alternatively, the above step (B) can comprise the step of forming the recess in the first substrate between a pair of the facing first electrodes by a mechanical excavation method or a mechanical grinding method. The mechanical excavation method includes a dicing saw method, and, the mechanical grinding method includes a sand blasting method. These mechanical methods also will be used in this sense hereinafter.

The method for the production of an alternating current driven type plasma display device according to the second aspect of the present invention for achieving the above object includes the steps of (A) forming a conductive material layer on the first substrate, (B) patterning the conductive material layer to form the first electrodes, and further, forming a recess in the first substrate between a pair of the first electrodes facing each other, and (C) forming the protective layer on the first electrode group and on the first substrate including the inside of the recess, to fabricate the first panel.

In the method for the production of an alternating current driven type plasma display device according to the second aspect of the present invention, the above step (B) can comprise the steps of forming a patterned resist layer on the conductive material layer, then etching (wet-etching or dry-etching) the conductive material layer using the resist layer as an etching mask, and further, etching (wet-etching or dry-etching) the first substrate, whereby the recess constituted of a trench can be obtained. Alternatively, the above step (B) can comprise the step of patterning the conductive material layer and further forming the recess in the first substrate by a mechanical excavation method or a mechanical grinding method, whereby the recess constituted of a trench can be obtained.

The method for the production of an alternating current driven type plasma display device according to the third aspect of the present invention for achieving the above object includes the steps of (A) forming a recess in a portion of the first substrate between regions of the first substrate on which regions a pair of the facing first electrodes are to be formed, (B) forming the patterned first electrodes on the surface of the first substrate and in the vicinity of the recess, and (C) forming the protective layer on the first electrode group and on the first substrate including the inside of the recess, to fabricate the first panel.

In the method for the production of an alternating current driven type plasma display device according to the third aspect of the present invention, the above step (A) can comprise the step of forming the recess in the first substrate by any one of a mechanical method, a chemical method and a direct method. In this manner, the recess constituted of a trench or a blind hole can be obtained. The mechanical method includes a mechanical excavation method and a mechanical grinding method. The chemical method includes a wet etching method and a dry etching method. The direct method includes a method in which the first substrate is produced, for example, by a hot press method.

In the alternating current driven type plasma display device or its production method according to the present invention, the rare gas charged in the space surrounded by the protective layer, the fluorescence layer and a pair of the separation walls has a pressure of $2.0\times10^4$ Pa (0.2 atmospheric pressure) to $3.0\times10^5$ Pa (3 atmospheric pressures), preferably $4.0\times10^4$ Pa (0.4 atmospheric pressure) to $2.0\times10^5$ Pa (2 atmospheric pressures). When the spatial width of the trench or the spatial diameter of the blind hole is less than $2.0\times10^{-5}$ m, the pressure of the rare gas in the space is $2.0\times10^4$ Pa (0.2 atmospheric pressure) to $3.0\times10^5$ Pa (3 atmospheric pressures), preferably $4.0\times10^4$ Pa (0.4 atmospheric pressure) to $2.0\times10^5$ Pa (2 atmospheric pressures). When the pressure of the rare gas in the space is adjusted to the above pressure range, the fluorescence layer emits light when irradiated with vacuum ultraviolet ray generated mainly on the basis of cathode glow in the rare gas. With an increase in pressure in the above pressure range, the sputtering ratio of various members constituting the plasma display device decreases, which results in an increase in the lifetime of the plasma display device.

The second electrode group constituted of a plurality of second electrodes may be formed on the first substrate or on the second substrate. In the former case, the second electrodes are formed on an insulating layer formed on the protective layer, and the extending direction of the second electrodes and the extending direction of the first electrodes make a predetermined angle (for example, 90°). In the latter case, the second electrodes are formed on the second substrate, the extending direction of the second electrodes and the extending direction of the first electrodes make a predetermined angle (for example, 90°), and the fluorescence layers are formed on or above the second electrodes.

The electrically conductive material constituting the frist electrodes or the conductive material layer differs depending upon whether the plasma display device is a transmission type or a reflection type. In the transmission type plasma display device, since light emission from the fluorescence layers is observed through the second substrate, it is not any problem whether the electrically conductive material constituting the first electrodes or the conductive material layer is transparent or non-transparent. In this case, however, when the second electrodes are formed on the second substrate, the electrically conductive material constituting the second electrodes is desirably transparent.

In the reflection type plasma display device, since light emission from the fluorescence layers is observed through the first substrate, when the second electrodes are formed on the second substrate, it is not any problem whether the electrically conductive material constituting the second electrodes is transparent or non-transparent. In this case, however, the electrically conductive material constituting the first electrodes or the conductive material layer is desirably transparent.

The term "transparent or non-transparent" is based on the transmissivity of the electrically conductive material to light at a wavelength of emitted light (visible light region) inherent to the fluorescent materials. That is, when an electrically conductive material constituting the first electrodes or the conductive material layer is transparent to light emitted from the fluorescence layers, it can be said that the electrically conductive material is transparent. The non-transparent electrically conductive material includes Ni, Al, Au, Ag, Pd/Ag, Cr, Ta, Cu, Ba, $LaB_6$, $Ca_{0.2}La_{0.8}CrO_3$, etc., and these materials may be used alone or in combination. The transparent electrically conductive material includes ITO (indium-tin oxide) and $SnO_2$.

In the method for the production of an alternating current driven type plasma display device according to the first or third aspect of the present invention, the method for forming the first electrodes can be properly selected from a deposition method, a sputtering method, a CVD method, a printing method, a lift-off method or the like depending upon the electrically conductive material to be used. That is, a printing method using an appropriate mask or a screen may be employed to form the first electrodes having predetermined patterns from the beginning, or after an electrically conductive material layer is formed on the entire surface by a deposition method, a sputtering method or a CVD method, the electrically conductive material may be patterned to form the first electrodes, or the first electrodes may be formed by a so-called lift-off method.

In the method for the production of an alternating current driven type plasma display device according to the second aspect of the present invention, the method for forming the conductive material layer can be selected from a deposition method, a sputtering method, a CVD method, a printing method, a lift-off method or the like, as required.

In addition to the first electrodes, preferably, bus electrodes composed of a material having a lower electric resistivity than the first electrodes are formed on the first substrate for decreasing the impedance of the first electrode. The bus electrode can be composed, typically, of a metal material such as Ag, Al, Ni, Cu, Cr or a Cr/Cu/Cr stacked film. In the reflection type plasma display device, the bus electrode composed of the above metal material can be a factor in decreasing the transmission quantity of visible light that is emitted from the fluorescence layers and passes through the first substrate, so that the brightness of a display screen is decreased. It is therefore preferred to form the bus electrode so as to be as narrow as possible so long as the electric resistance value necessary for the first electrodes can be obtained.

The protective layer may have a single-layered structure or a stacked structure. The material for forming the single-layered protective layer includes magnesium oxide (MgO), magnesium fluoride ($MgF_2$) and aluminum oxide ($Al_2O_3$). Of these, magnesium oxide is a suitable material having properties such as chemical stability, a low sputtering rate, a high light transmissivity at the wavelength of light emitted from the fluorescence layers and a low discharge starting voltage. The protective layer may be formed of a stacked structure composed of at least two materials selected from the group consisting of magnesium oxide, magnesium fluoride and aluminum oxide.

Otherwise, the protective layer may have a two-layered structure. The protective layer having a two-layered structure can be constituted of a dielectric layer which is in contact with the first electrode group, and a covering layer that is formed on the dielectric layer and has a higher secondary electron emission efficiency than the dielectric layer. Typically, the dielectric layer is composed of a low-melting glass or $SiO_2$. Typically, the covering layer is composed of magnesium oxide (MgO), magnesium fluoride ($MgF_2$) or aluminum oxide ($Al_2O_3$). The above two-layered structure can be employed for securing the tranparency of the protective layer as a whole with the dielectric layer and securing a high secondary electron emission efficiency with the covering layer when the transparency (light transmissivity) of the covering layer in the wavelength region of vacuum ultraviolet ray is not so high. In the above two-layered structure, a stable discharge sustain operation can be attained, and the vacuum ultraviolet ray is absorbed less into the protective layer. Further, there can be obtained a structure in which visible light emitted from the fluorescence layers is absorbed less into the protective layer.

Since the protective layer is formed on the first substrate and on the first electrode group, the direct contact of ions and electrons to the first electrode group can be prevented. As a result, wearing of the first electrode group can be prevented. In addition to these, further, the protective layer works to accumulate a wall charge generated during an address period, works to emit secondary electrons necessary for discharge, works as a resistor to limit an excess discharge current and works as a memory to sustain a discharge state.

Examples of the material for the first substrate and the second substrate include soda glass ($Na_2O.CaO.SiO_2$), borosilicate glass ($Na_2O.B_2O_3.SiO_2$), forsterite ($2MgO.SiO_2$) and lead glass ($Na_2O.PbO.SiO_2$). The material for the first substrate and the material for the second substrate may be the same as, or different from, each other.

The plasma display device of the present invention is a so-called facing discharge type plasma display device. strictly, the first electrode group plays a role as an electrode lead, and the true electrode is the protective layer.

When the second electrodes are formed on the second substrate, preferably, a dielectric film is formed on the second substrate, and the fluorescence layers are formed on the dielectric film. The material for the dielectric film can be selected from a low-melting glass or $SiO_2$.

The separation wall is formed between the fluorescence layers which are neighboring to each other. In other words, the separation walls can have a constitution in which the separation wall extends in parallel with the second electrodes in regions between one second electrode and another neighboring second electrode. That is, there can be employed a structure in which one second electrode extends between a pair of the separation walls. In some cases, the separation walls may be constituted of a first separation wall extending in parallel with the first electrodes in regions between one first electrode and another neighboring first electrode and second separation wall extending in parallel with the second electrodes in regions between one second electrode and another neighboring second electrode (that is, the form of a grille). Such grille-shaped separation walls are conventionally used in the DC type plasma display device, and they also can be applied to the alternating current driven type plasma display device of the present invention.

The material for constituting the separation walls can be selected from known insulating materials, and for example, there can be used a material prepared by mixing a widely used low-melting glass with a metal oxide, such as alumina. The method for forming the separation walls includes a screen printing method, a sand blasting method, a dry film method and a photosensitive method. The above screen printing method refers to a method in which opening portions are formed in those portions of a screen which correspond to portions where the separation walls are to be formed, a material for constituting the separation walls on the screen is passed through the opening portions with a squeeze to form layers for constituting the separation walls on the second substrate (or on the dielectric film when the dielectric film is used), and then the layers for constituting the separation walls are calcined or sintered.

The above dry film method refers to a method in which a photosensitive film is laminated on the second substrate (or on the dielectric film when the dielectric film is used), the photosensitive film on regions where the separation walls are to be formed is removed by exposure and development, opening portions formed by the removal are filled with a material for forming the separation walls. The photosensitive film is combusted and removed by calcining or sintered, and the material for forming the separation walls, filled in the opening portions, remains to form the separation walls.

The above photosensitive method refers to a method in which a photosensitive material layer for forming the separation walls is formed on the second substrate (or on the dielectric film when the dielectric film is used), the photosensitive material layer is patterned by exposure and development and then the photosensitive patterned material layer is calcined or sintered.

The above sand blasting method refers to a method in which a layer for constituting the separation walls is formed on the second substrate (or on the dielectric film when the dielectric film is used), for example, by screen printing or with a roll coater, a doctor blade or a nozzle-spraying coater, and is dried. Then, those portions where the separation walls are to be formed in the layer are masked with a mask layer and exposed portions of the layer are removed by a sand blasting method.

The separation walls may be formed in black to form a so-called black matrix, so that a high contrast of the display screen can be attained. The method of forming the black separation walls includes a method in which a light-absorbing, layer such as a photosensitive silver paste layer or a low-reflection chromium layer is formed on the top portion of each of the separation walls and a method in which the separation walls are formed from a color resist material colored in black. The separation walls may have a meander structure.

The fluorescence layer is composed of a fluorescence material selected from the group consisting of a fluorescence material which emits light in red, a fluorescence material which emits light in green and a fluorescence material which emits light in blue. The fluorescence layer is formed on or above the second substrate. When the second electrodes are formed on the second substrate, specifically, the fluorescence layer composed of a fluorescence material which emits light, for example, of a red color (red fluorescence layer), is formed on or above one second electrode, the fluorescence layer composed of a fluorescence material which emits light, for example, of a green color (green fluorescence layer), is formed on or above another second electrode, and the fluorescence layer composed of a fluorescence material which emits light, for example, of a blue color (blue fluorescence layer), is formed on or above still another second electrode. These three fluorescence layers for emitting light of three primary colors form one set, and such sets are formed in a predetermined order. When the second electrodes are formed on the first substrate, the red fluorescence layer, the green fluorescence layer and the blue fluorescence layer are formed on the second substrate, these three fluorescence layers form one set, and such sets are formed in a predetermined order. A region where the first electrodes (a pair of the first electrodes) and one set of the fluorescence layers which emit light of three primary colors overlap corresponds to one pixel. The red fluorescence layer, the green fluorescence layer and the blue fluorescence layer may be formed in the form of a stripe, or may be formed in the form of a grille. When the red fluorescence layer, the green fluorescence layer and the blue fluorescence layer are formed in the form of a stripe, and when the second electrodes are formed on the second substrate, one red fluorescence layer is formed on or above one second electrode, one green fluorescence layer is formed on or above one second electrode, and one blue fluorescence layer is formed on or above one second electrode. When the red fluorescence layers, the green fluorescence layers and the blue fluorescence layers are formed in the form of a grille, the red fluorescence layer, the green fluorescence layer and the blue fluorescence layer are formed on or above one second electrode in a predetermined order.

When the second electrodes are formed on the second substrate, the fluorescence layer may be formed directly on the second electrode, or the fluorescence layer may be formed on the second electrode and on the side walls of the separation walls. Otherwise, the fluorescence layer may be formed on the dielectric film formed on the second electrode, or the fluorescence layer may be formed on the dielectric film formed on the second electrode and on the side walls of the separation walls. Further, the fluorescence layer may be formed only on the side walls of the separation walls. "The fluorescence layers are formed on or above the second substrate" conceptually includes all of the above various embodiments. When the second electrode is formed on the first substrate, the fluorescence layer may be formed on the second substrate, the fluorescence layer may be formed on the second substrate and on the side walls of the separation walls, or the fluorescence layer may be formed only on the side walls of the separation walls.

As the fluorescence material for constituting the fluorescence layer, fluorescence materials which have a high quantum efficiency and causes less saturation to vacuum ultraviolet ray can be selected from known fluorescence materials, as required. Since the plasma display device is used as a color display device, it is preferred to combine fluorescence materials which have color purities close to the three primary colors defined in NTSC, which are well balanced to give white when three primary colors are mixed, which show a small afterglow time period and which can ensure that the afterglow time periods of the three primary colors are nearly equal. Examples of the fluorescence material which emits light in red when irradiated with vacuum ultraviolet ray include ($Y_2O_3$: Eu), ($YBO_3$Eu), ($YVO_4$:EU), ($Y_{0.96}P_{0.60}V_{0.40}O_4$:$Eu_{0.04}$), [(Y,Gd)$BO_3$:Eu], ($GdBO_3$:Eu), ($ScBO_3$:Eu) and (3.5MgO.0.5$MgF_2$.$GeO_2$:Mn). Examples of the fluorescence material which emits light in green when irradiated with vacuum ultraviolet ray include ($ZnSiO_2$:Mn), ($BaAl_{12}O_{19}$:Mn), ($BaMg_2Al_{16}O_{27}$:Mn), ($MgGa_2O_4$:Mn), ($YBO_3$:Tb), ($LUBO_3$:Tb) and ($Sr_4Si_3O_8Cl_4$:Eu). Examples of the fluorescence material which emits light in blue when irradiated with vacuum ultraviolet ray include ($Y_2SiO_5$:Ce), ($CaWO_4$:Pb), $CaWO_4$, $YP_{0.85}V_{0.15}O_4$, ($BaMgAl_{14}O_{23}$:Eu), ($Sr_2P_2O_7$:Eu) and ($Sr_2P_2O_7$:Sn).

The methods for forming the fluorescence layers include a thick film printing method, a method in which fluorescence particles are sprayed, a method in which an adhesive substance is pre-applied to a region where the fluorescence layer is to be formed and fluorescence particles are allowed to adhere, a method in which a photosensitive fluorescence paste (slurry) is provided and a fluorescence layer is patterned by exposure and development, and a method in which a fluorescence layer is formed on the entire surface and unnecessary portions are removed by a sand blasting method.

The rare gas to be sealed in the space is required to satisfy the following requirements.

(1) The rare gas is chemically stable and permits setting of a high gas pressure from the viewpoint of attaining a longer lifetime of the plasma display device;

(2) The rare gas permits the high radiation intensity of vacuum ultraviolet ray from the viewpoint of attaining a higher brightness of a display screen;

(3) The radiated vacuum ultraviolet ray has a long wavelength from the viewpoint of increasing energy conversion efficiency from vacuum ultraviolet ray to visible light; and (4) The discharge starting voltage is low from the viewpoint of decreasing power consumption.

The rare gas includes He (wavelength of resonance line= 58.4 nm), Ne (ditto=74.4 nm), Ar (ditto=107 nm), Kr (ditto=124 nm) and Xe (ditto=147 nm). While these rare gases may be used alone or as a mixture, mixed gases are particularly useful since a decrease in the discharge starting voltage based on a Penning effect can be expected. Examples of the above mixed gases include Ne—Ar mixed gases, He—Xe mixed gases and Ne—Xe mixed gases. Of these rare gases, Xe having the longest resonance line wavelength is suitable since it also radiates an intense ultraviolet ray having a wavelength of 172 nm.

The light emission state of glow discharge in a discharge cell will be explained below with reference to FIGS. 17A, 17B, 18A and 18B. FIG. 17A schematically shows a light emission state when DC glow discharge is carried out in a discharge tube with rare gas sealed therein. From a cathode to an anode, an Aston dark space A, a cathode glow B, a cathode dark space (Crookes dark space) C, negative glow D, a Faraday dark space E, a positive column F and anode glow G consecutively appear. In AC glow discharge, a cathode and an anode are repeatedly alternated at a predetermined frequency, so that the positive column F is positioned in a central area between the electrodes and the Faraday dark spaces E, the negative glows D, the cathode dark spaces C, the cathode glows B and the Aston dark spaces A and appear consecutively symmetrically on the both sides of the positive column F. The state shown in FIG. 17B is observed when the distance between the electrodes is sufficiently large like a fluorescent lamp.

As the distance between the electrodes is decreased, the length of the positive column F decreases. When the distance between the electrodes is further decreased, the positive column F disappears, the negative glow D is positioned in the central area between the electrodes, and the cathode dark spaces C, the cathode glows B and the Aston dark spaces A appear symmetrically on both sides in this order, as shown in FIG. 18A. The state shown in FIG. 18A is observed when the distance between the electrodes is approximately $1\times10^{-4}$ m. In the plasma display device of the present invention, a pair of the first electrodes for sustaining discharge are arranged in parallel, so that the negative glow is formed in a space region near a surface portion of the protective layer covering the first electrode corresponding to the cathode.

When the distance between the electrodes comes to be less than $5\times10^{-5}$ m, the cathode glow B is positioned in the central area between the electrodes and the Aston dark spaces A appear on both sides of the cathode glow B, as is schematically shown in FIG. 18B. In some cases, the negative glow can partly exist. In the plasma display device of the present invention, a pair of the first electrodes for sustaining discharge are arranged in parallel, so that the cathode glow is formed in a space region near a surface portion of the protective layer covering the first electrode corresponding to the cathode and a space region in the recess. When the spatial width of the trench or the spatial diameter of the blind hole is arranged to be less than $5\times10^{-5}$ m, as described above, and when the pressure in the space is adjusted to at least $2.0\times10^4$ Pa (0.2 atmospheric pressure) but not higher than $3.0\times10^5$ Pa (3 atmospheric pressures), the cathode glow can be used as a discharge mode. Therefore, high AC glow discharge efficiency can be therefore achieved, and as a result, a high light-emission efficiency and a high brightness can be attained in the plasma display device.

In the present invention, since the recess is formed in the first substrate between a pair of the first electrodes for generating discharge, the discharge space can be increased in volume and the route (path) from one of a pair of the first electrodes to the other can be increased.

BRIEF DESCRIPTION OF THE DRAWINGS

The present invention will be explained with reference to the drawings hereinafter.

FIG. 3C, are schematic partial cross-sectional views of the first substrate, etc., for explaining the method for producing the first panel in the method for the production of the alternating current driven type plasma display device in Example 1 of the present invention.

FIG. 8C, are schematic partial cross-sectional views of the first substrate, etc., for explaining the method for producing the first panel in method for the production of an alternating current driven type plasma display device in Example 2 of the present invention.

DESCRIPTION OF THE PREFERRED EMBODIMENTS

EXAMPLE 1

Figure 2:
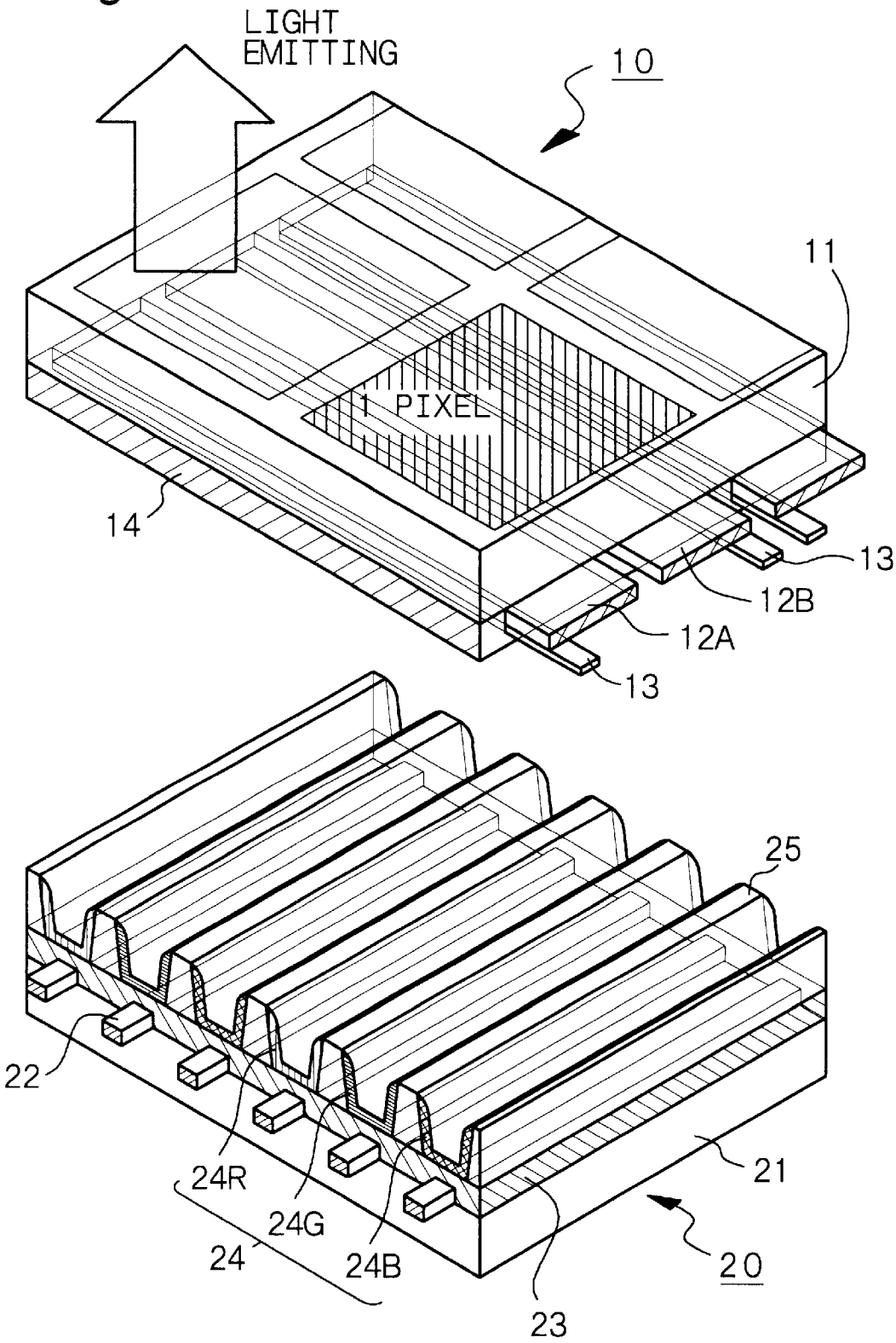
FIG. 2 is a conceptual exploded perspective view of a plasma display device.
Figure 3A:
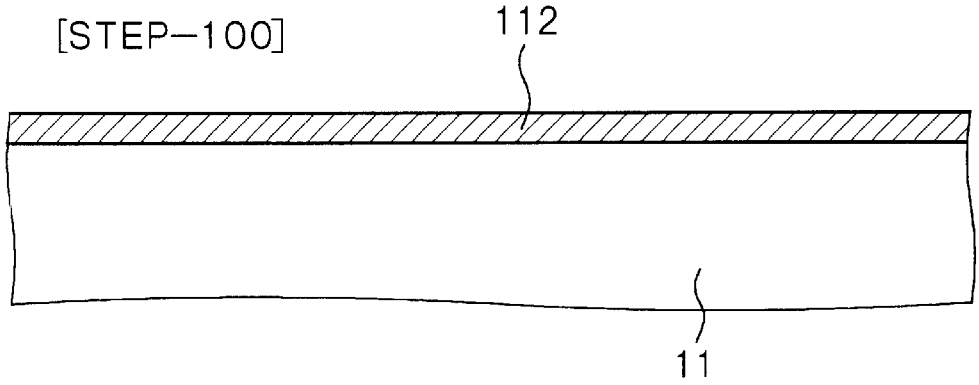
FIGS. 3A, 3B and 3C are schematic partial cross-sectional views of a first substrate, etc., for explaining the method for producing a first panel in the method for the production of an alternating current driven type plasma display device in Example 1 of the present invention.
Figure 3B:
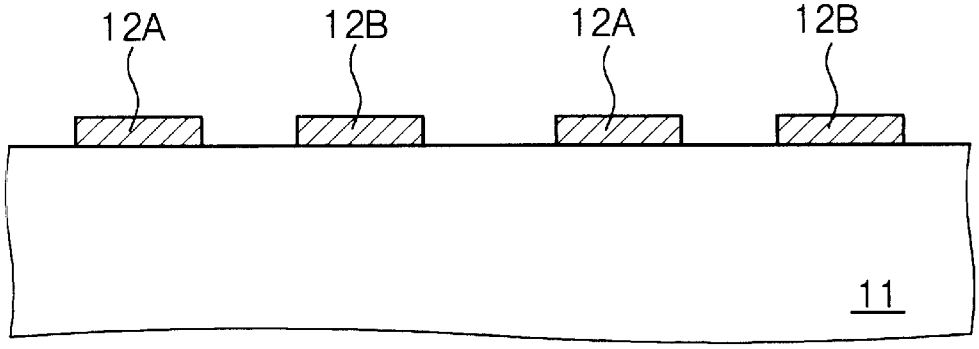
Figure 3C:
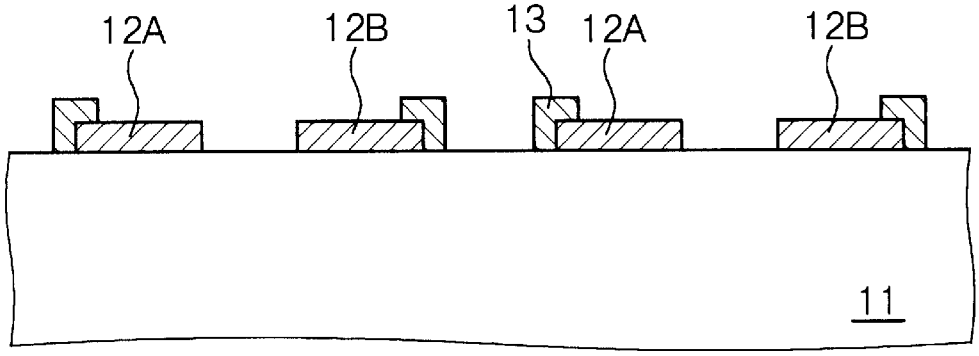
Figure 4A:
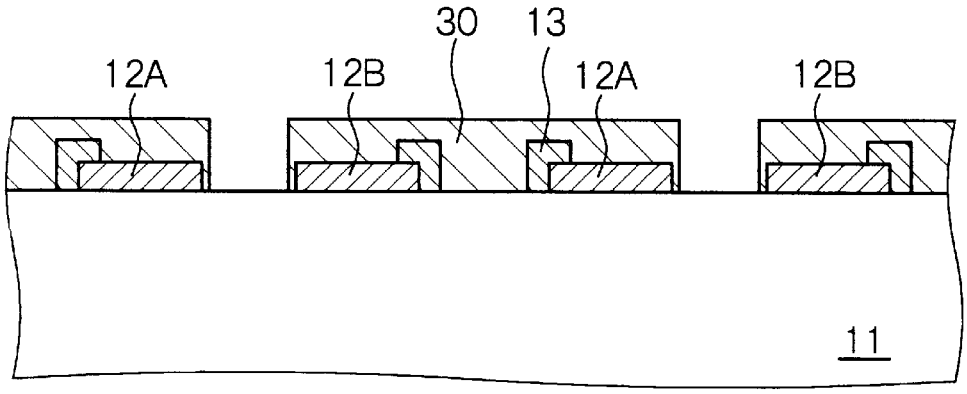
FIGS. 4A and 4B, following
Figure 4B:
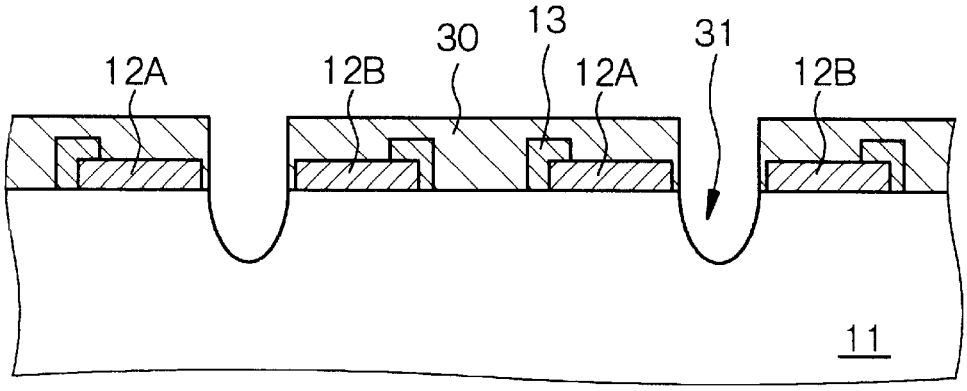

Example 1 is concerned with the alternating current driven type plasma display device of the present invention and the method for the production of an alternating current driven type plasma display device according to the first aspect of the present invention. The schematic exploded perspective view of the plasma display device of Example 1 is generally as shown in FIG. 2. The plasma display device has a front panel 10 as a first panel and a rear panel 20 as a second panel. The front panel 10 comprises a first substrate 11 made, for example, of glass, a first electrode group constituted of a plurality of first electrodes 12A and 12B formed on the first substrate 11, and a protective layer 14 formed on the first substrate 11 and on the first electrode group. In edge portions of the first electrodes 12A and 12B, bus electrodes 13 extending in parallel with the first electrodes 12A and 12B are formed.

The rear panel 20 comprises a second substrate 21 made, for example, of glass, a second electrode group constituted of a plurality of second electrodes (also called address electrodes or data electrodes) 22 formed on the second substrate 21 in the form of a stripe, fluorescence layers 24 formed above the second electrodes 22, and separation walls 25 each of which is formed between one second electrode 22 and another neighboring second electrode 22. A dielectric film 23 is formed on the second substrate 21 and on the second electrodes 22. The separation walls 25 composed of an insulating material are formed on regions which are on the dielectric film 23 between one second electrode 22 and another neighboring second electrode 22, and the separation walls 25 extend in parallel with the second electrodes 22. The fluorescence layers 24 are provided so as to be on, and to extend from, the dielectric film 23 and so as to be on the side walls of the separation walls 25. The fluorescence layers 24 include a red fluorescence layer 24R, a green fluorescence layer 24G and a blue fluorescence layer 24B, and the fluorescence layers 24R, 24G and 24B of these colors are provided in a predetermined order.

FIG. 2 is the exploded perspective view, and in the actual plasma display device, top portions of the separation walls 25 on the rear panel side are in contact with the protective layer 14 on the front panel side. Further, the front panel 10 and the rear panel 20 are arranged such that the protective layer 14 faces the fluorescent layers 24, and the front panel 10 and the rear panel 20 are bonded to each other in their circumferential portions with a seal layer (not shown). A region where a pair of the first electrodes 12A and 12B and a pair of the separation walls 25 overlap corresponds to a discharge cell. Further, a region where a pair of the first electrodes 12A and 12B and one combination of the fluorescence layers 24R, 24G and 24B of three primary colors overlap corresponds to one pixel. A space formed by the front panel 10 and the rear panel 20 is charged, for example, with Ne—Xe mixed gases (for example, 50% Ne—50% Xe mixed gases) under a pressure of $8\times10^4$ Pa (0.8 atmospheric pressure). That is, the rare gas is sealed in the spaces surrounded by the neighboring separation walls 25, the fluorescent layers 24 and the protective layer 14.

Figure 1A:
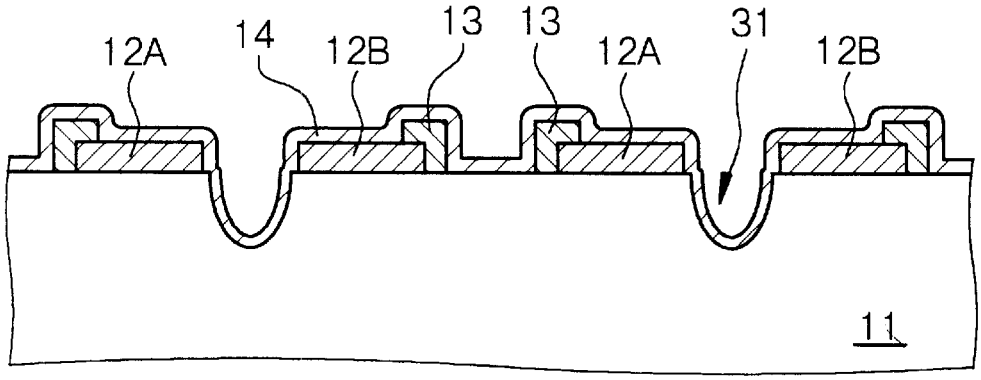
FIGS. 1A and 1B are a schematic partial cross-sectional view of a first panel of the plasma display device of the present invention and a schematic drawing showing the positional relationship of first electrodes and separation walls, respectively.
Figure 1B:
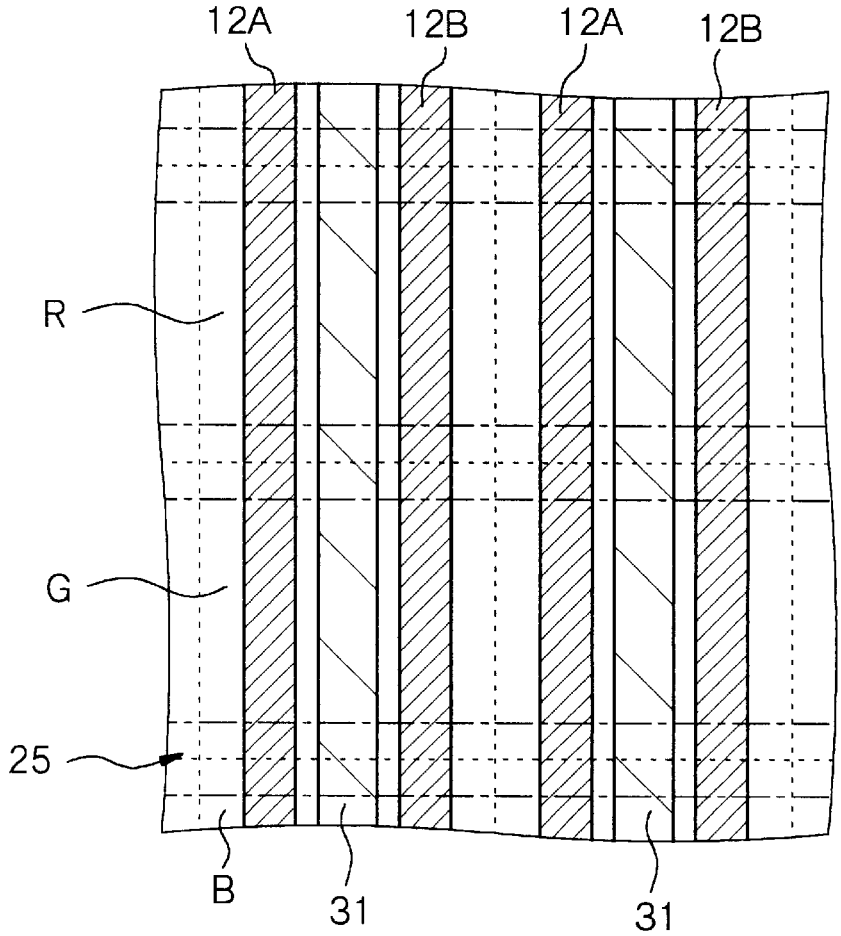

FIG. 1A shows a schematic partial cross-sectional view of the front panel 10. Further, FIG. 1B schematically shows a positional relationship of the first electrodes 12A and 12B, etc., with the separation walls 25. In FIG. 1B, the separation walls 25 are shown by alternate long and short dash lines, each discharge cell (section) is indicated by dotted lines. While the rear panel 20 is positioned above the front panel 10 in FIG. 1A, showing of the rear panel 20 is omitted. In FIG. 1B, further, showing of the bus electrode 13 is omitted.

As shown in FIGS. 1A and 1B, a recess 31 is formed in the first substrate 11 between a pair of the facing first electrodes 12A and 12B. In FIG. 2, showing of the recess 31 is omitted. In the embodiment shown in FIG. 1, the recess 31 is a trench. As shown in FIG. 1B, the recess 31 is formed between a pair of the first electrodes 12A and 12B and in parallel with these first electrodes 12A and 12B. The extending direction of the first electrodes 12A and 12B and the extending direction of the separation walls 25 make a predetermined angle, for example, of 90°. The protective layer 14 is formed on the side walls and the bottom of the recess 31. Under some conditions for forming the protective layer 14, there are some cases where no protective layer is formed on part of the side walls or the bottom of the recess 31. However, such is not any problem.

In FIG. 1B, a red fluorescence layer 24R is formed above a region of the second substrate 21 which corresponds to a region interposed between a pair of the separation walls 25 and indicated by reference "R", a green fluorescence layer 24G is formed above a region of the second substrate 21 which corresponds to a region interposed between a pair of the separation walls 25 and indicated by reference "G", and a blue fluorescence layer 24B is formed above a region of the second substrate 21 which corresponds to a region interposed between a pair of the separation walls 25 and indicated by reference "B". The neighboring discharge cells for emitting light in red, green and blue constitute one pixel. Each pixel generally has the outer form of a square, and one pixel is divided into three discharge cells with the separation walls 25. In FIG. 1B, however, each pixel is shown as having a rectangular form.

The first electrodes 12A and 12B are formed on the first substrate 11, and they are composed of a transparent electrically conductive material such as ITO. As an electrically conductive material for constituting the bus electrode 13, there is used a material having a lower electric resistivity than ITO, such as a Cr/Cu/Cr stacked film. The bus electrode 13 has a sufficiently narrow line width as compared with the line width of the first electrodes 12A and 12B, so that the brightness of a display screen (upper surface of the first substrate 11 in FIG. 2) is not impaired. The bus electrode 13 may be formed so as to cover the side walls of the first electrodes 12A and 12B as shown in FIG. 1A, or they may be formed such that the side walls of the bus electrode 13 and the side walls of the first electrodes 12A and 12B are brought into agreement as shown in FIG. 2.

The second electrode group is a set of second electrodes 22 formed on the second substrate 21 in the form of a stripe. Each second electrodes 22 is composed, for example, of silver or aluminum and contributes not only to the starting of discharge together with the first electrodes 12A and 12B but also to the reflection of light emitted from the fluorescence layers 24 to a display screen side to improve the display screen in brightness. Each fluorescent layer 24 is constituted of a red fluorescent layer 24R, a green fluorescent layer 24G and a blue fluorescent layer 24B, and these fluorescent layers 24R, 24G and 24B which emit light of three primary colors constitute one combination and are formed above the second electrodes 22 in a predetermined order.

One example of AC glow discharge operation of the above-constituted plasma display device will be explained below. First, a pulse voltage lower than a discharge starting voltage $V_{bd}$ is applied to all of the first electrodes 12A and 12B for a short period of time. A wall charge is thereby generated on the surface of the protective layer 14 near one of the first electrodes due to dielectric polarization, the wall charge is accumulated, and the apparent discharge starting voltage decreases. Thereafter, while a voltage is applied to the second electrodes (address electrodes) 22, a voltage is applied to one of the first electrodes included in a discharge cell that is not allowed to display, whereby discharging is caused between the second electrode 22 and the one of the first electrodes, to erase the accumulated wall charge. This erasing discharge is consecutively carried out in the second electrodes 22. Meanwhile, no voltage is applied to one of the first electrodes included in a discharge cell that is not allowed to display, whereby the accumulated wall charge is retained. Then, a predetermined pulse voltage (discharge sustain voltage $V_{sus}$) is applied between all of the pairs of the first electrodes 12A and 12B. As a result, the cell where the wall charge is accumulated is caused to discharge between the pair of the first electrodes 12A and 12B, and in the discharge cell, the fluorescence layer excited by irradiation with vacuum ultraviolet ray generated by glow discharge in the rare gas emits light in color characteristic of the kind of a fluorescent material. The phases of the discharge sustain voltage applied to one of the first electrodes and the phase of the discharge sustain voltage applied to the other first electrode deviate from each other by half a cycle, and the polarity of each electrode is reversed according to the frequency of alternate current.

Another example of the AC glow discharge operation of the above-structured plasma display device will be explained below. The discharge operation is divided into an address period for which a wall charge is generated on the surface of the protective layer 14 by an initial discharge and a discharge sustain period for which the discharge is sustained. In the address period, a pulse voltage lower than the discharge starting voltage $V_{bd}$ is applied to selected one of the first electrodes and a selected second electrode 22. A region where the pulse-applied one of the first electrodes and the pulse-applied second electrode 22 overlap is selected as a display pixel, and in the overlap region, the wall charge is generated on the surface of the protective layer 14 due to dielectric polarization, whereby the wall charge is accumulated. In the succeeding discharge sustain period, a discharge sustain voltage $V_{sus}$ lower than $V_{bd}$ is applied to a pair of the first electrodes 12A and 12B. When the sum of the wall voltage $V_w$ induced by the wall charge and the discharge sustain voltage $V_{sus}$ comes to be greater than the discharge starting voltage $V_{bd}$, (i.e., when $V_w+V_{sus}>V_{bd}$), discharging is initiated. The phases of the sustain voltages $V_{sus}$ applied to one of the first electrodes and the phase of the sustain voltages $V_{sus}$ applied to the other of the first electrodes deviate from each other by half a cycle, and the polarity of each electrodes is reversed according to the frequency of alternate current.

In a pixel where the AC glow discharge is sustained, the fluorescent layers 24 are excited by irradiation with vacuum ultraviolet ray radiated due to the excitation of the rare gas in the space, and they emilt light having colors characteristic of kinds of fluorescent materials.

Figure 12A:
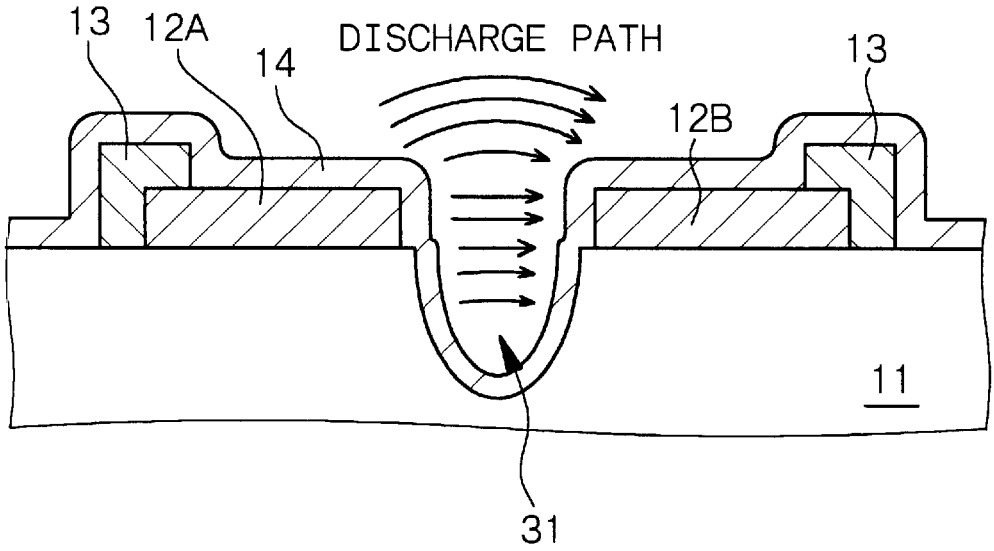
FIGS. 12A and 12B are conceptual drawings for explaining discharge paths in the plasma display device of the present invention and a conventional plasma display device, respectively.
Figure 12B:
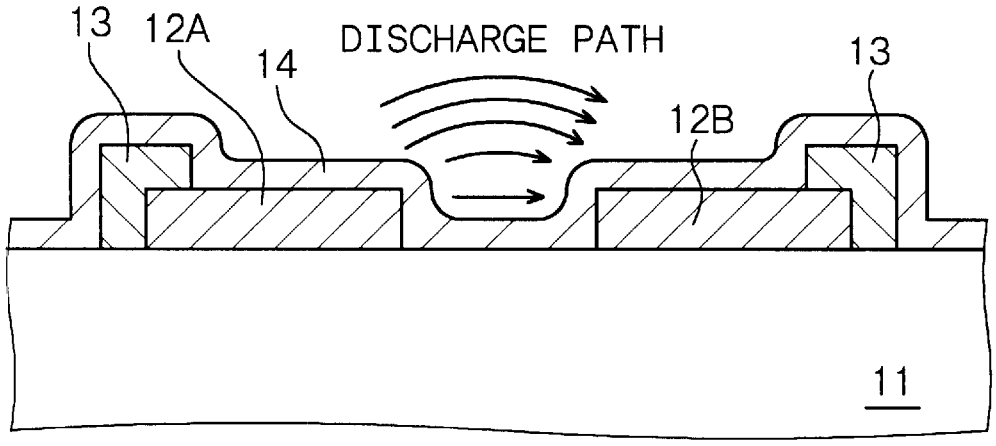
Fig. 12B (PRIOR ART)
Figure 13A:
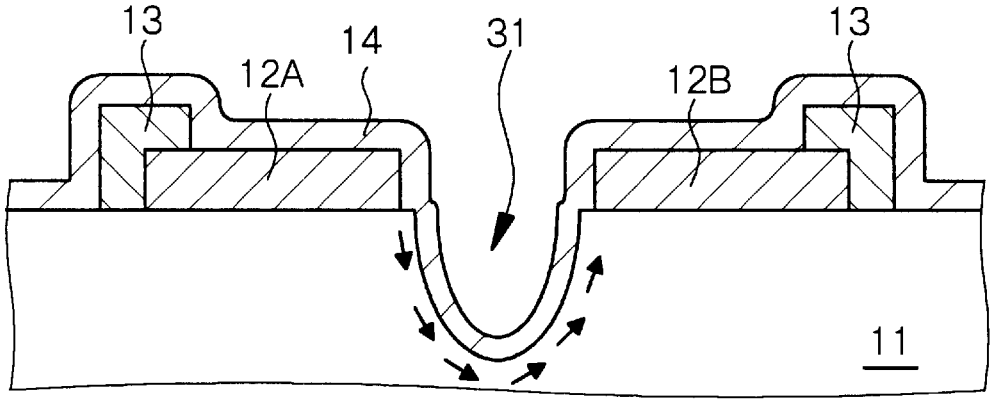
FIGS. 13A and 13B are conceptual drawings for explaining the paths of leak current conducted in the surface of a first substrate in the plasma display device of the present invention and a conventional plasma display device, respectively.
Figure 14A:
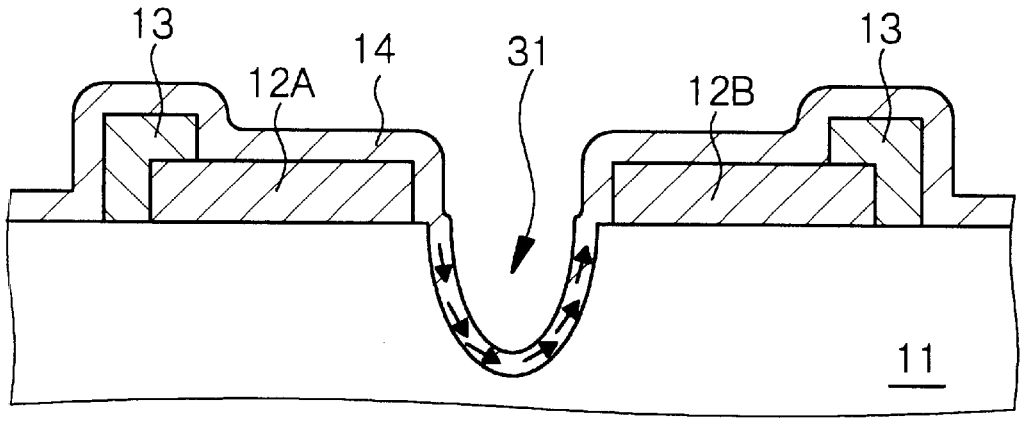
FIGS. 14A and 14B are conceptual drawings for explaining the paths of leak current conducted in a protective layer in the plasma display device of the present invention and a conventional plasma display device, respectively.
Figure 15A:
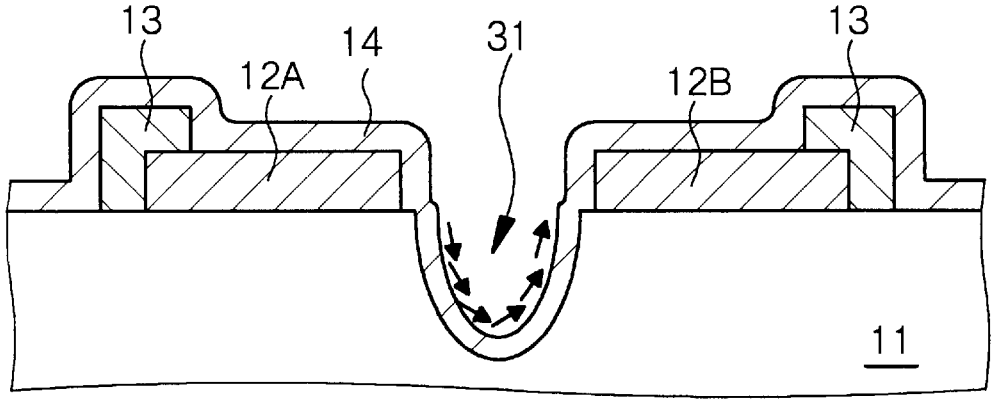
FIGS. 15A and 15B are conceptual drawings for explaining the paths of leak current conducted along the surface of a protective layer in the plasma display device of the present invention and a conventional plasma display device, respectively.

In the plasma display device of the present invention, since the recess 31 is formed in the first substrate 11 between a pair of the facing first electrodes 12A and 12B, the discharge space increases in volume and the discharge path increases, as shown in FIG. 12A. That is, discharging can take place between the surface of the protective layer 14 near the facing first electrode 12A and the surface of the protective layer 14 near the facing first electrode 12B and between the surfaces of the facing side walls of the recess. That is, the number of metastable particles (metastable rare gas atoms and molecules and dimers in the discharge space) required for starting and sustaining the discharge can be increased, so that there is caused no increase in the discharge starting voltage or the discharge sustain voltage, nor is there caused a decrease in efficiency. Further, as shown in FIG. 13A, the path of a leak current conducted in the surface of the first substrate 11 increases, and, as shown in FIG. 14A, the path of a leak current conducted in the protective layer 14 also increases. Further, as shown in FIG. 15A, the path of a leak current conducted along the surface of the protective layer 14 also increases. Therefore, the leak current flows to a lesser degree, and dielectric breakdown or abnormal discharge takes place to a lesser degree.

Figure 13B:
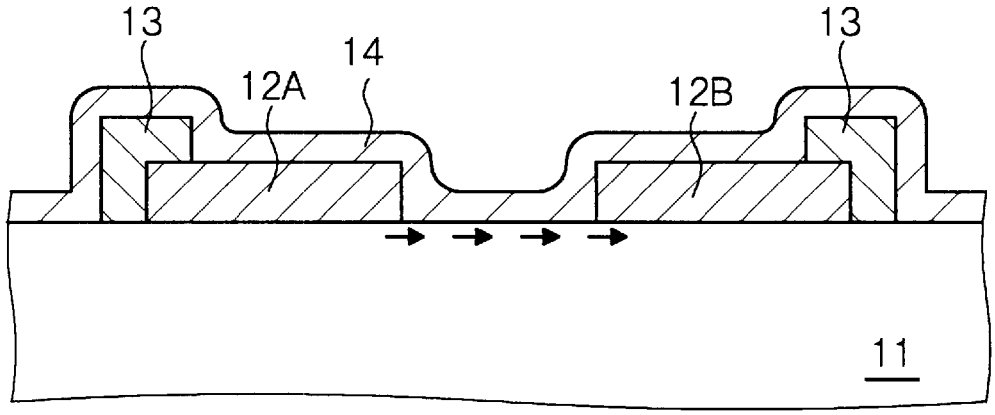
Fig. 13B (PRIOR ART)
Figure 14B:
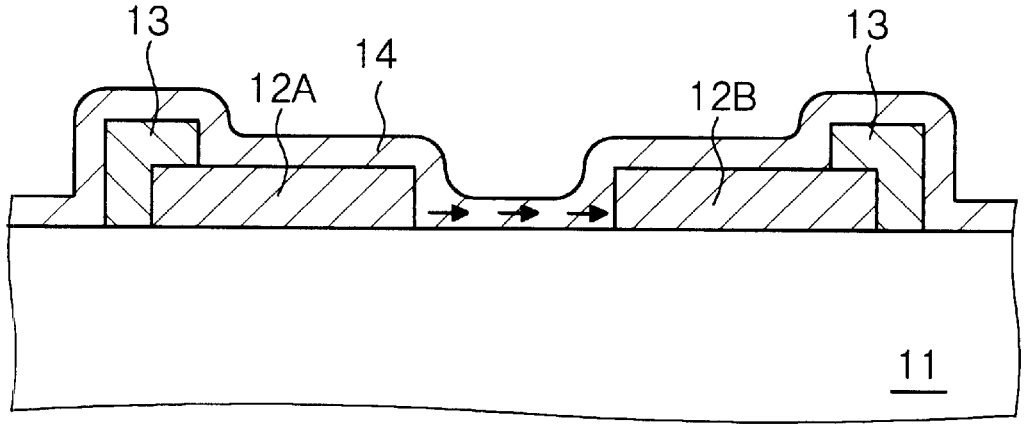
Fig. 14B (PRIOR ART)
Figure 15B:
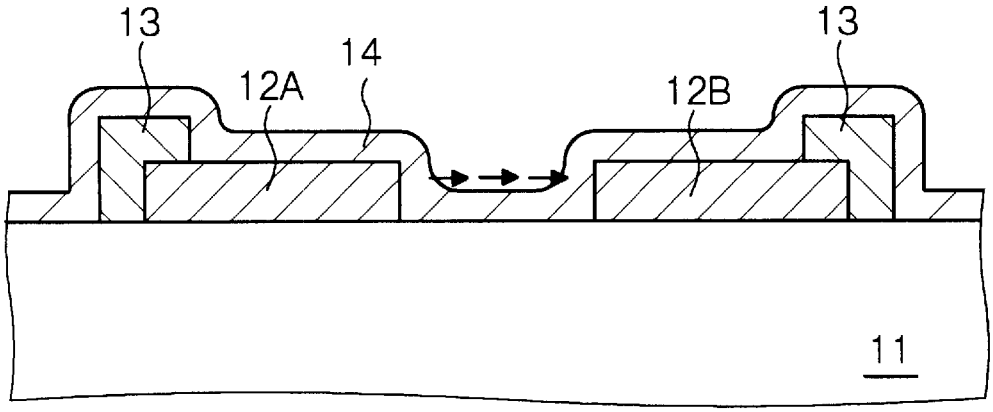
Fig. 15B (PRIOR ART)
Figure 16A:
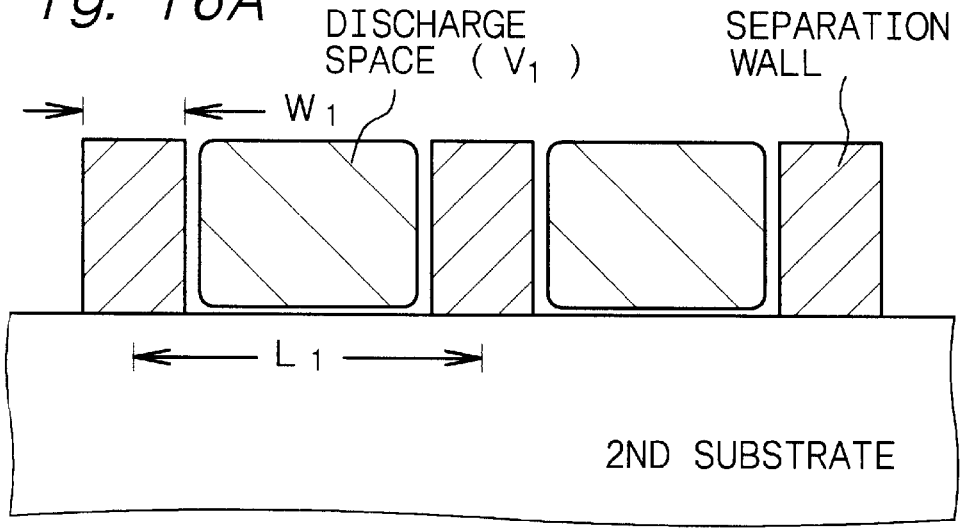
FIGS. 16A and 16B are conceptual drawings for explaining a state where one discharge cell is decreased in dimensions.
Figure 16B:
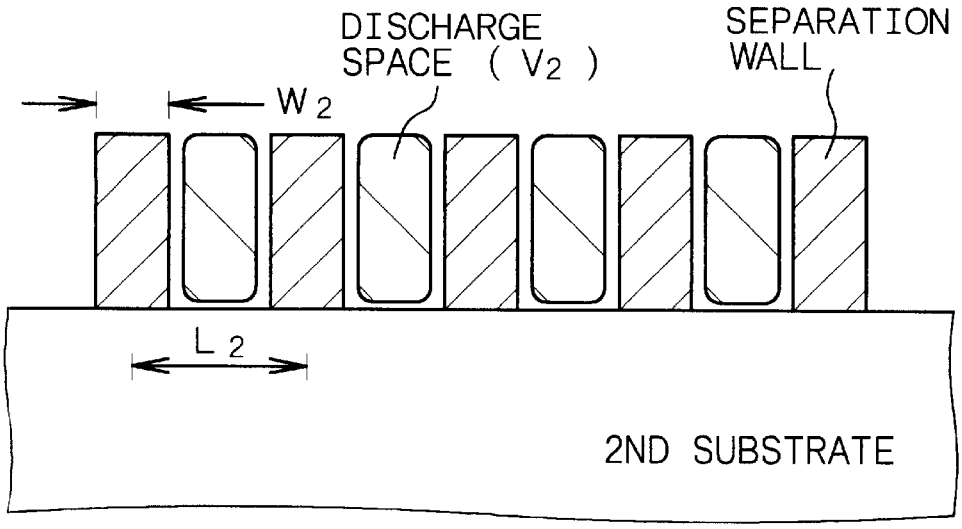
Figure 17A:
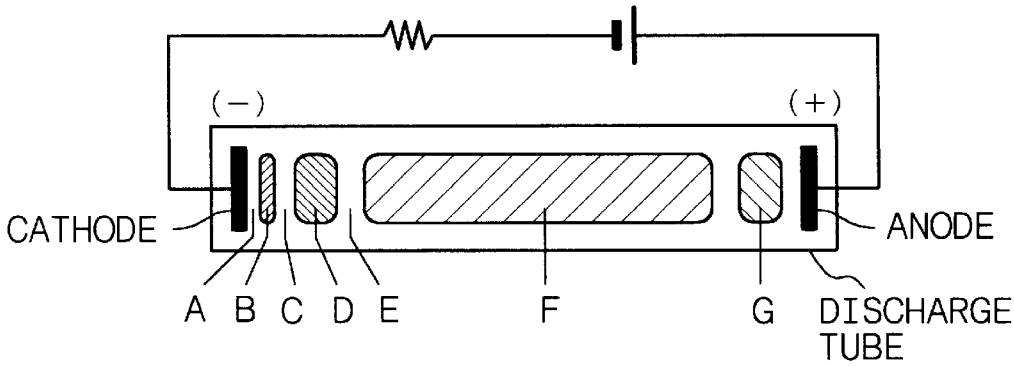
FIGS. 17A and 17B are schematic drawings of light emission states of glow discharge in a discharge cell.
Figure 17B:
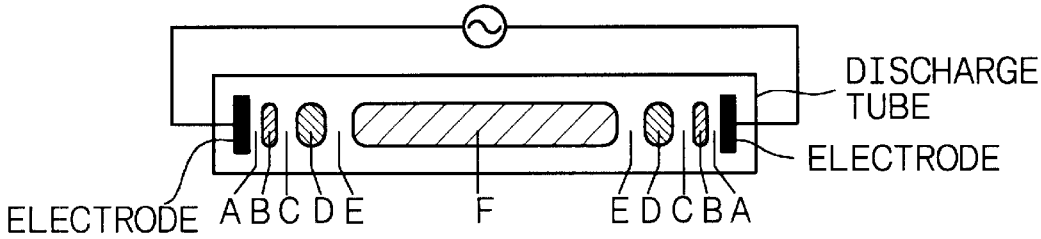
Figure 18A:
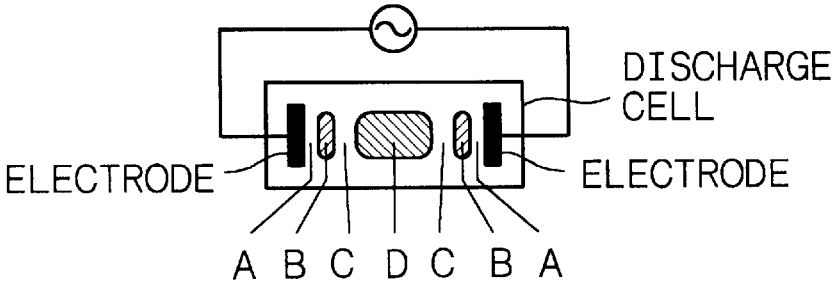
FIGS. 18A and 18B are schematic drawings of light emission states of glow discharge in a discharge cell.
Figure 18B:
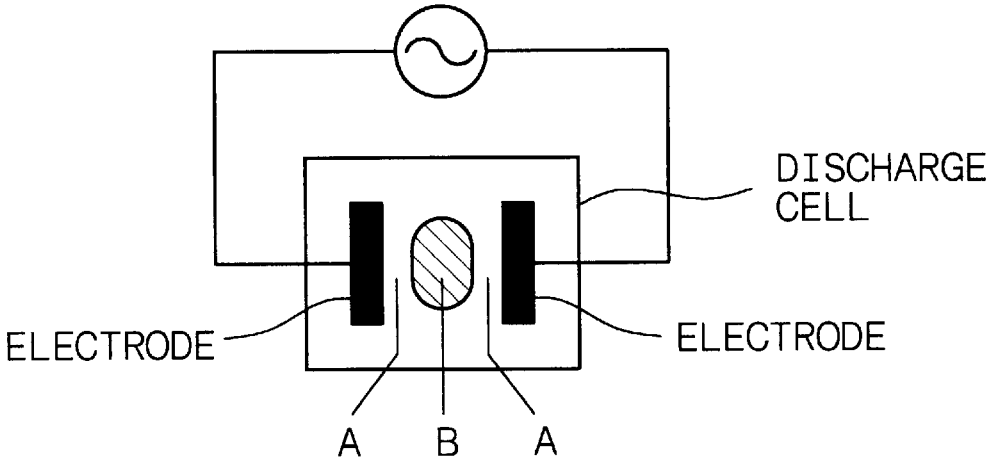
Figure 19:
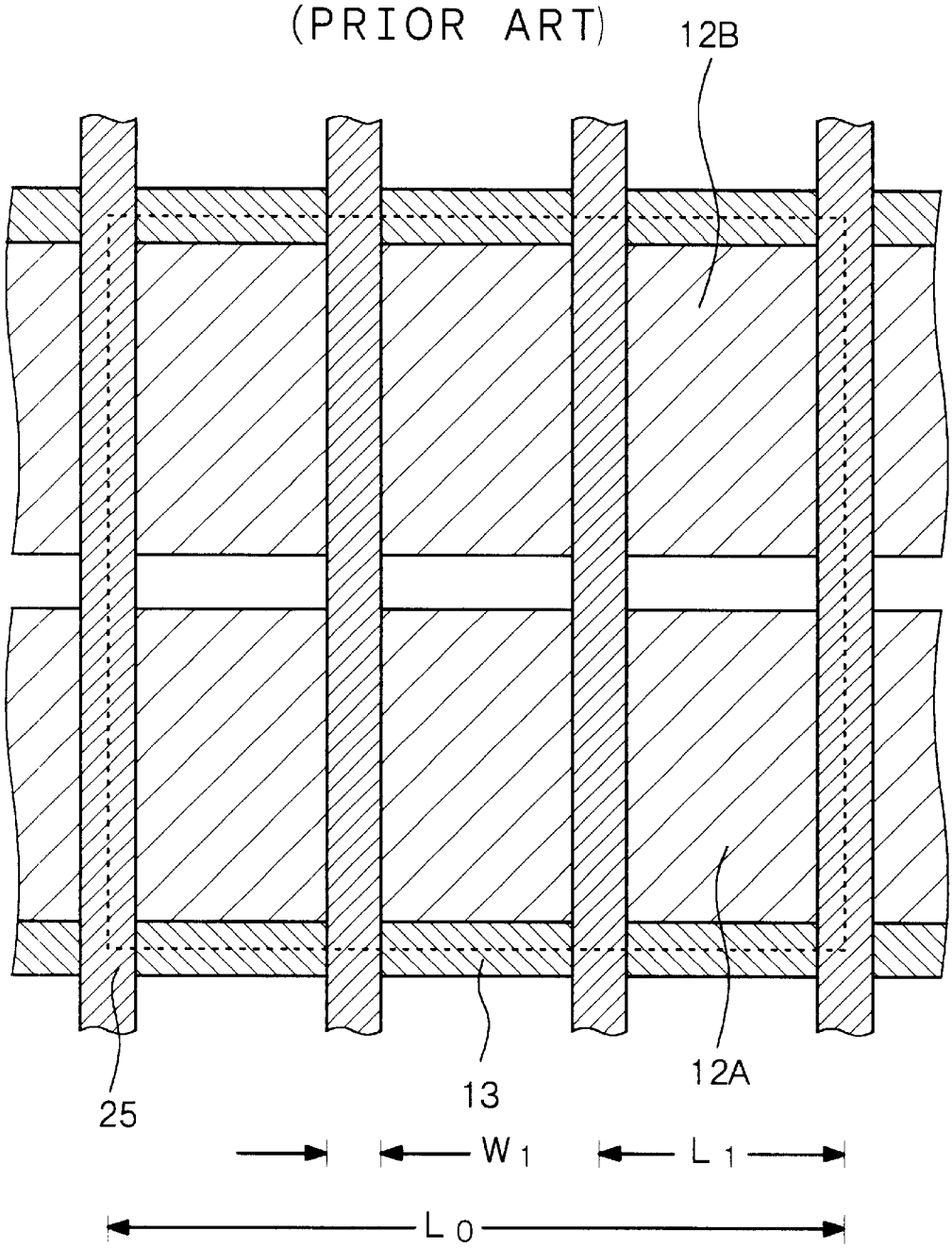
Fig. 19 (PRIOR ART)
FIG. 19 is a schematic drawing showing the positional relationship of a pair of facing first electrodes to separation walls in a conventional plasma display device.

In a conventional plasma display device, when the distance between a pair of facing first electrodes is decreased, the discharge space is decreased in volume, the number of the metastable particles (metastable rare gas atoms and molecules and dimers in the discharge space) required for starting and sustaining the discharge is decreased, the discharge starting voltage and the discharge sustain voltage increase, and efficiency is downgraded. Further, as shown in FIG. 13B, the path of a leak current conducted in the surface of the first substrate 11 decreases, and as shown in FIG. 14B, the path of a leak current conducted in the protective layer 14 also decreases. Further, as shown in FIG. 15B, the path of a leak current conducted along the surface of the protective layer 14 decreases, so that the leak current is liable to flow and dielectric breakdown or abnormal discharge is liable to take place.

The method for the production of an alternating current driven type plasma display device of Example 1 (method for the production of an alternating current driven type plasma display device according to the first aspect of the present invention) will be explained with reference to the schematic partial cross-sectional views of the first substrate 11, etc., shown in FIGS. 3A, 3B, 3C, 4A and 4B. In the following explanation, the first substrate 11, all the structures formed thereon, the second substrate 21, or all the structures formed thereon at any stages of the production method will be sometimes referred to as "substratum".

The front panel 10 as a first panel can be fabricated as follows.

[Step-100]

First, the patterned first electrodes 12A and 12B are formed on the first substrate 11. Specifically, a conductive material layer 112 composed of ITO is formed on the entire surface of the first substrate 11, for example, by a sputtering method (see FIG. 3A), and the conductive material layer 112 is patterned in the form of stripes by lithography and an etching method, whereby the first electrodes 12A and 12B can be formed (see FIG. 3B). Then, a Cr/Cu/Cr stacked film is formed on the entire surface of the substratum, for example, by a sputtering method, and the Cr/Cu/Cr stacked film is patterned by lithography and an etching method, whereby the bus electrode 13 can be formed (see FIG. 3C). The edge portion of one of the first electrodes 12A and 12B and the edge portion of the bus electrode 13 overlap each other.

[Step-110]

Then, the recess 31 is formed in the first substrate 11 between a pair of the facing first electrodes 12A and 12B. A trench is employed as the recess 31. Specifically, a resist layer 30 having an opening portion between a pair of the facing first electrodes 12A and 12B is formed on the entire surface by lithography. That is, a resist material is applied to the entire surface to cover the first substrate 11 with a resist layer 30, excluding a portion of the first substrate 11 in which portion the recess is to be formed (see FIG. 4A). Then, the first substrate 11 is patterned by a wet etching method using hydrofluoric acid, a dry etching method using etching gas with using the resist layer 30 as an etching mask or a sand blasting method, to form the recess 31 in the first substrate 11 between a pair of the facing first electrodes 12A and 12B (see FIG. 4B). Then, the resist layer 30 is removed. The trench is formed to have a width of $4\times10^{-5}$ m (40 $\mu$m) in an upper portion thereof and a depth of $8\times10^{-5}$ m (80 $\mu$m). In the drawings, it is shown that the bottom of the recess is rounded. Under some etching conditions, the recess 31 has a rectangular cross-sectional form when cut with the YZ plane.

[Step-120]

Then, the protective layer 14 is formed on the first electrode group and on the first substrate 11 including an inside of the recess 31. The protective layer 14 may be an approximately $1\times10^{-5}$ m (approximately 10 $\mu$m) thick single layer composed of magnesium oxide (MgO), or may have a two-layered structure constituted of an approximately 10 $\mu$m thick dielectric layer and an approximately 0.6 $\mu$m thick covering layer. The dielectric layer can be formed, for example, by forming a low-melting glass paste layer on the substratum by a screen printing method and by calcining or sintering the low-melting glass paste layer. The covering layer or the protective layer constituted of a single layer can be obtained, for example, by forming a magnesium oxide layer on the entire surface of the dielectric layer, or on the first substrate and the first electrode group, by an electron beam deposition method. By the above steps, the front panel 10 can be completed. The trench has a spatial width of approximately $2\times10^{-5}$ m (20 $\mu$m).

The rear panel 20 as a second panel can be fabricated as follows. First, a silver paste is printed on the second substrate 21 in the form of a stripe, for example, by a screen printing method, and the printed silver paste is calcined or sintered, whereby the second electrodes 22 can be formed. Then, a low-melting glass paste layer is formed on the entire surface of the substratum by a screen printing method, and the low-melting glass paste layer is calcined or sintered, whereby the dielelectric film 23 is formed. Then, a low-melting glass paste is printed on the dielelectric film 23 above a region between neighboring second electrodes 22, for example, by a screen printing method, and the glass paste layer is calcined or sintered, to form the the separation walls 25. The height of the separation walls (ribs) 25 can be, for example, 50 to 300 $\mu$m. Then, fluorescence material slurries for three primary colors are consecutively printed, followed by calcining or sintering, to form the fluorescent layers 24R, 24G and 24B. By the above steps, the rear panel 20 can be completed.

Then, the plasma display device is assembled. First, a seal layer (not shown) is formed on a circumferential portion of the rear panel 20, for example, by a screen printing method. Then, the front panel 10 and the rear panel 20 are attached to each other, followed by calcining or sintering, to cure the seal layer. Then, the space formed between the front panel 10 and the rear panel 20 is vaccumed, and then Ne—Xe mixed gases (for example, 50% Ne—50% Xe mixed gases) are charged at a pressure of $8\times10^{4}$ Pa (0.8 atmospheric pressure) and sealed in the space, to complete the plasma display device. If the front panel 10 and the rear panel 20 are attached and bonded to each other in a chamber charged with Ne—Xe mixed gases having a pressure of $8\times10^4$ Pa (0.8 atmospheric pressure), the steps of vacuuming and charging of Ne—Xe mixed gases in the space and sealing can be omitted.

Figure 5:
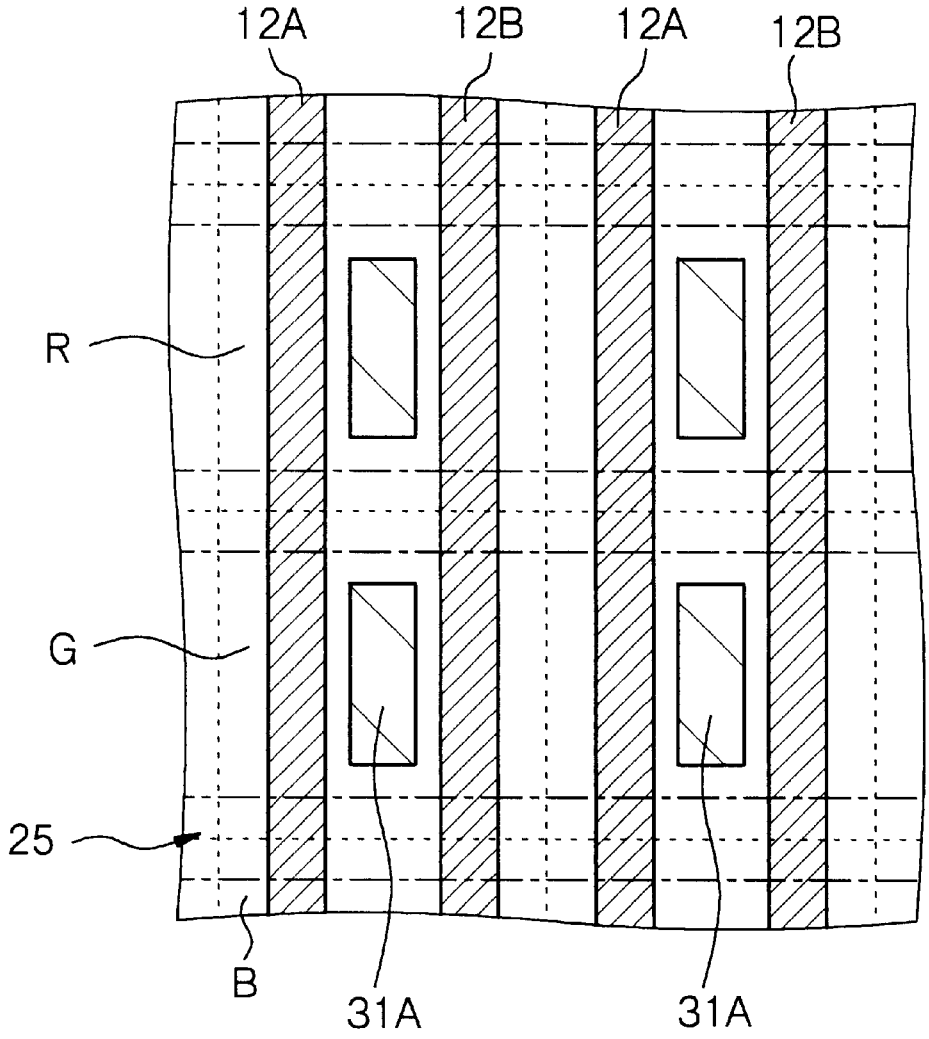
FIG. 5 is a schematic drawing showing the positional relationship of the first electrodes, etc., and the separation walls and showing a variant of the form of a recess in the plasma display device of the present invention.
Figure 6:
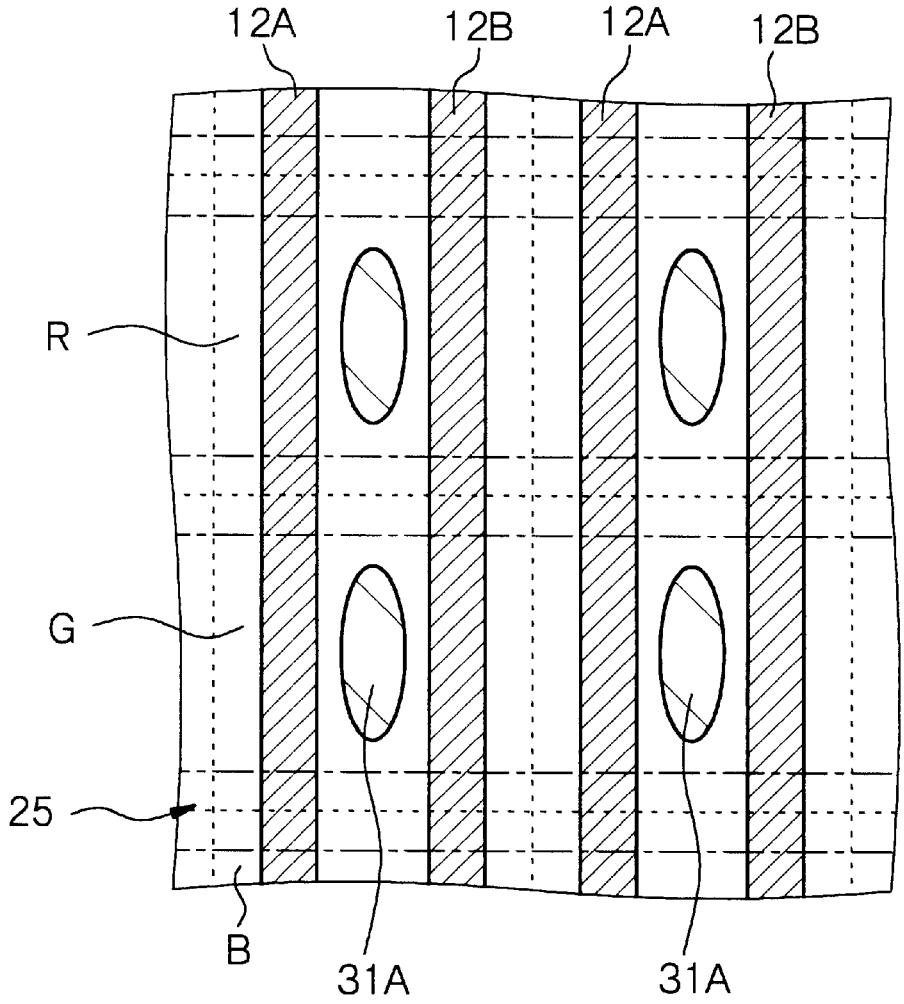
FIG. 6 is a schematic drawing showing the positional relationship of the first electrodes, etc., and the separation walls and showing a variant of the form of a recess in the plasma display device of the present invention.

When the recess is formed in [Step-110], the resist layer 30 having an opening portion between a pair of the facing first electrodes 12A and 12B is formed on the entire surface by lithography. If the opening portion is formed in the form of a rectangle or an oval without forming it in the form of a trench, the recess 31A is formed as a blind hole formed in the first substrate 11 positioned between a pair of the facing separation walls 25 (see FIG. 5 or FIG. 6). The above blind hole preferably has a spatial diameter of less than $5\times10^{-5}$ m. When the recess 31 is a trench, plasma discharge may leak to a neighboring discharge cell through the recess 31 in some case, and there may be caused an optical crosstalk, that is, the fluorescence layer of the neighboring discharge cell may emit light. When the recess 31A is formed as a blind hole in a region of the first substrate that is positioned between a pair of the separation walls 25, the above phenomenon can be reliably prevented.

Figure 7A:
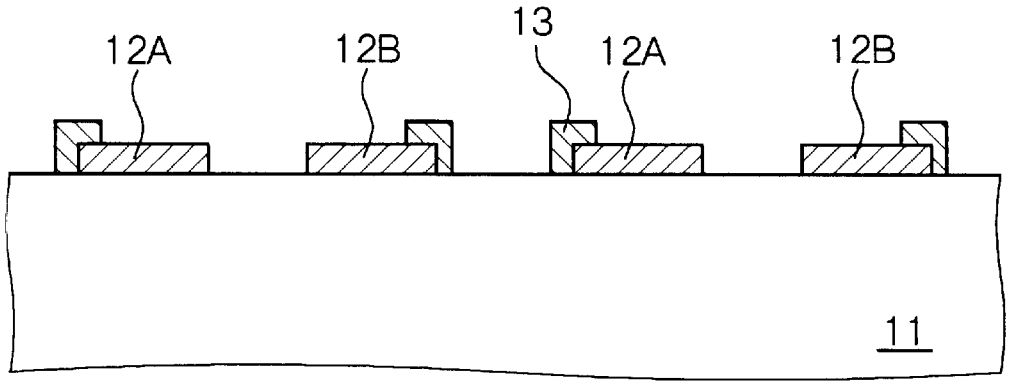
FIGS. 7A and 7B are schematic partial cross-sectional views of a first substrate, etc., for explaining a variant of the method for producing the first panel in the method for the production of an alternating current driven type plasma display device in Example 1 of the present invention.
Figure 7B:
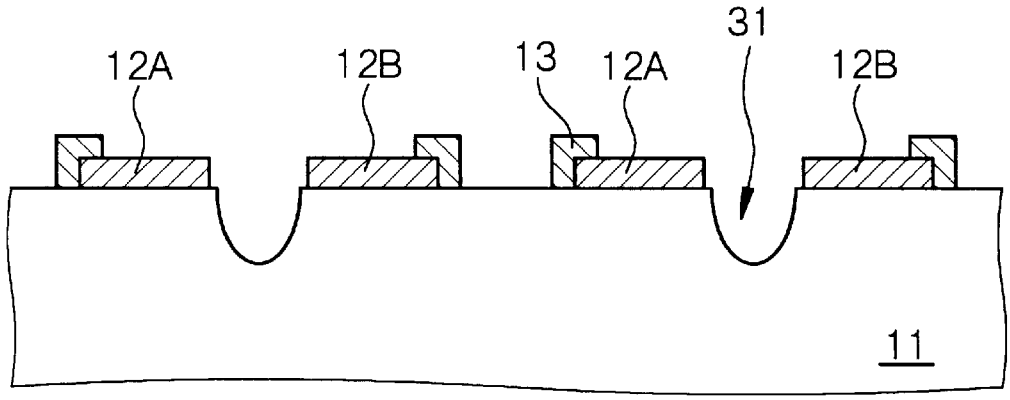
Figure 8A:
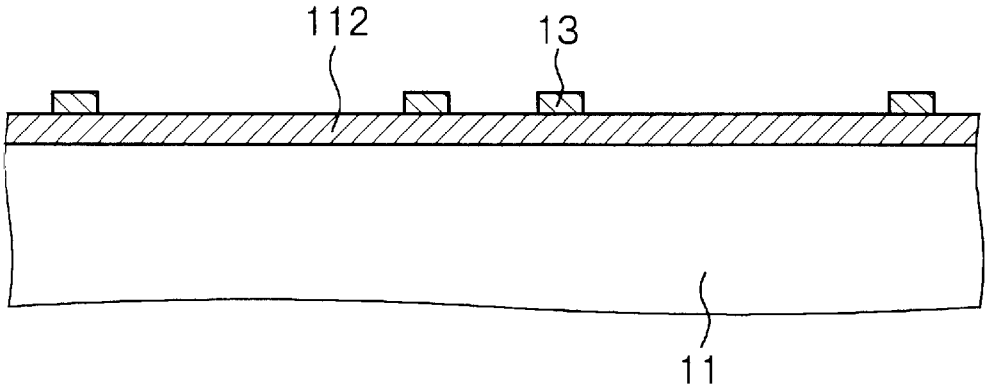
FIGS. 8A, 8B and 8C are schematic partial cross-sectional views of a first substrate, etc., for explaining the method for producing a first panel in the method for the production of an alternating current driven type plasma display device in Example 2 of the present invention.
Figure 8B:
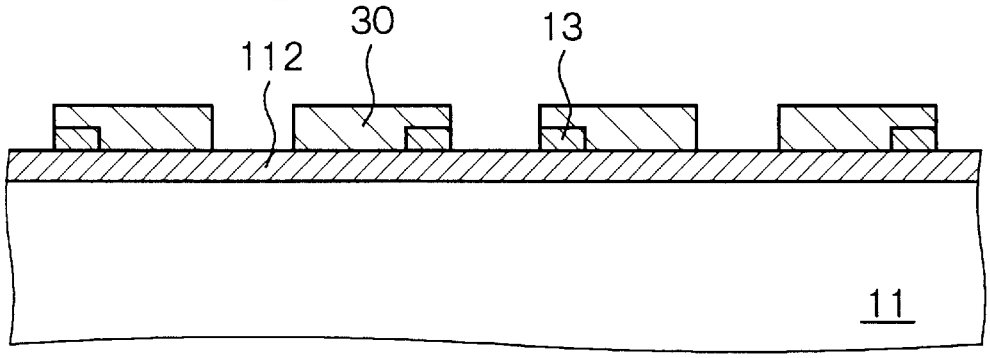
Figure 8C:
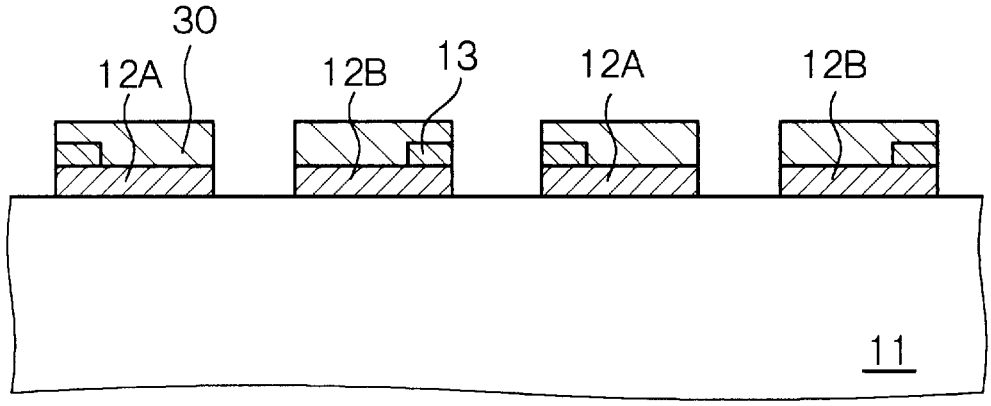

Alternatively, in [Step-110], the recess 31 can be formed in the first substrate 11 between a pair of the facing first electrodes 12A and 12B by a mechanical excavation method such as a dicing saw method or a mechanical grinding method such as a sand blasting method. That is, after that structure shown in FIG. 7A is obtained by completing [Step-100], the recess 31 is formed in the first substrate 11 with a dicing saw according to a dicing saw method, whereby the structure shown in FIG. 7B can be obtained.

EXAMPLE 2

Example 2 is concerned with the method for the production of an alternating current driven type plasma display device according to the second aspect of the present invention. Since the plasma display device produced in Example 2 is substantially structurally the same as the plasma display device explained in Example 1, detailed explanations thereof are omitted. The method for producing the front panel 10 as the first panel in the method for the production of an alternating current driven type plasma display device of Example 2 will be explained below with reference to the schematic partial cross-sectional views of the first substrate 11, etc., shown in FIGS. 8A, 8B, 8C, 9A and 9B.

[Step-200]

First, a conductive material layer 112 is formed on the first substrate 11. Specifically, the conductive material layer 112 composed of ITO is formed on the entire surface of the first substrate 11, for example, by a sputtering method. Then, a Cr/Cu/Cr stacked film is formed on the entire surface of the conductive material layer 112, for example, by a sputtering method, and the Cr/Cu/Cr stacked film is patterned by lithography and an etching method, whereby the bus electrode 13 can be formed (see FIG. 8A).

[Step-210]

Then, the conductive material layer 112 is patterned to form the first electrodes 12A and 12B, and further, the recess 31 is formed in the first substrate 11 between a pair of the facing first electrodes 12A and 12B. Specifically, a patterned resist layer 30 is formed on the conductive material layer 112 (see FIG. 8B). Then, the conductive material layer 112 is etched by a wet etching method using a solution of a mixture ferric chloride and hydrochloric acid using the resist layer 30 as an etching mask (see FIG. 8C). Then, the first substrate 11 is patterned, for example, by a wet etching method using hydrofluoric acid, a dry etching method using etching gas or a sand blasting method (see FIG. 9A). In this manner, the recess 31 constituted of a trench can be obtained. Then, the resist layer 30 is removed. The trench is formed to have a width of $4\times10^{-5}$ m (40 $\mu$m) in an upper portion thereof and a depth of $8\times10^{-5}$ m (80 $\mu$m). In the drawings, it is shown that the bottom of the recess 31 is rounded. Under some etching conditions, the recess 31 has a rectangular cross-sectional form when cut with the YZ plane. The recess also is formed in a region of the first substrate 11 which region is positioned between a pair of the first electrodes and a neighboring pair of the first electrodes.

[Step-220]

Figure 9A:
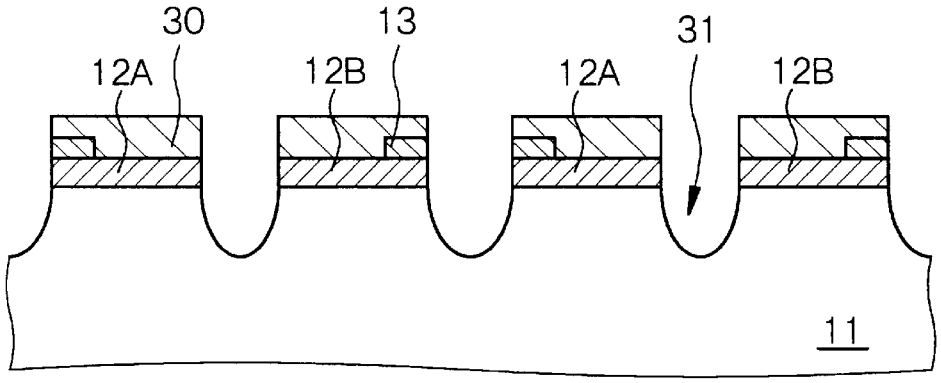
FIGS. 9A and 9B, following
Figure 9B:
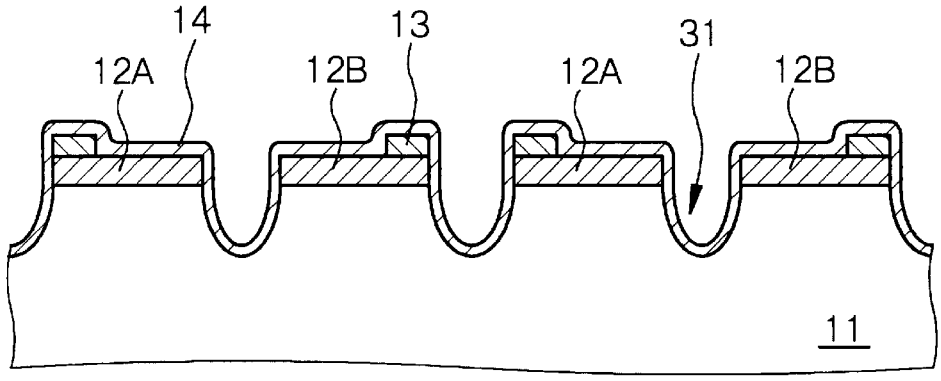

A protective layer 14 is formed on the first electrode group and the first substrate 11, including the inside of the recess 31, in the same manner as in [Step-120] in Example 1 (see FIG. 9B). The trench has a spatial width of approximately $2\times10^{-5}$ m (20 $\mu$m).

Figure 10A:
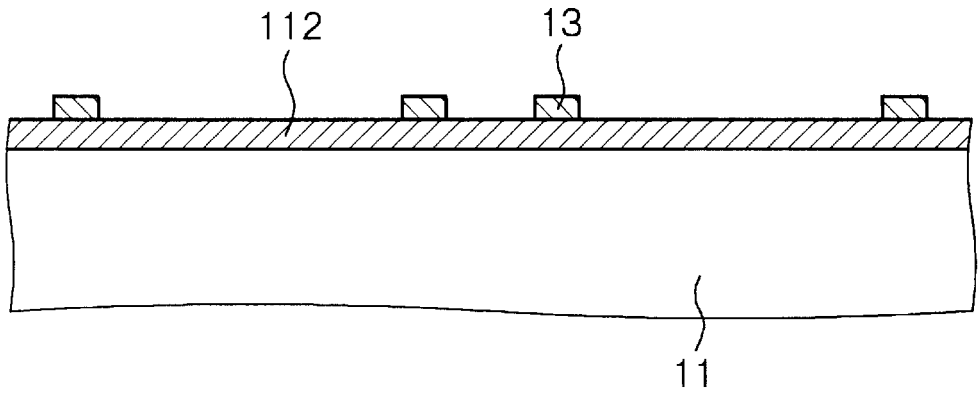
FIGS. 10A and 10B are schematic partial cross-sectional views of a first substrate, etc., for explaining a variant of the method for producing a first panel in the method for the production of an alternating current driven type plasma display device of Example 2 of the present invention.
Figure 10B:
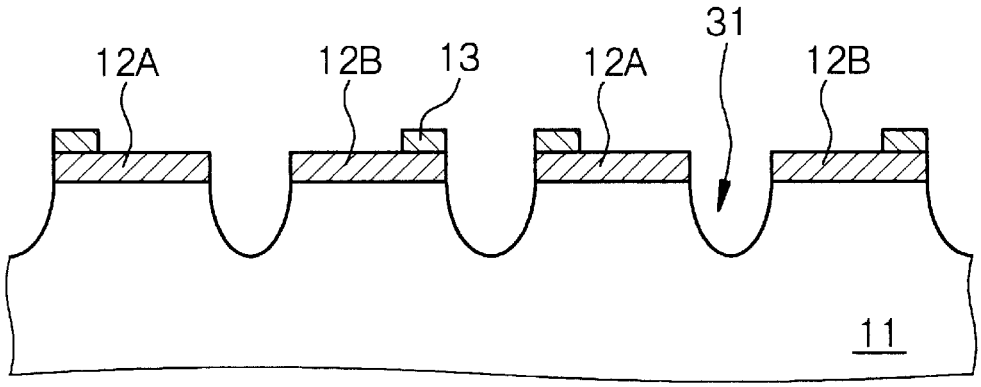

Alternatively, after the structure shown in FIG. 10A is obtained by completing [Step-200], [Step-210] may comprise the step of patterning the conductive material layer 112 and further forming the recess 31 in the first substrate 11 by a mechanical excavation method such as a dicing saw method, or a mechanical grinding method such as a sand blasting method (see FIG. 10B). In this manner, the recess 31 constituted of a trench can be obtained.

EXAMPLE 3

Example 3 is concerned with the method for the production of an alternating current driven type plasma display device according to the third aspect of the present invention. Since the plasma display device produced in Example 3 is substantially structurally the same as the plasma display device explained in Example 1, detailed explanations thereof are omitted. The method for producing the front panel 10 as the first panel in method for the production of an alternating current driven type plasma display device of Example 3 will be explained below with reference to the schematic partial cross-sectional views of the first substrate 11, etc., shown in FIGS. 11A, 11B and 11C.

[Step-300]

Figure 11A:
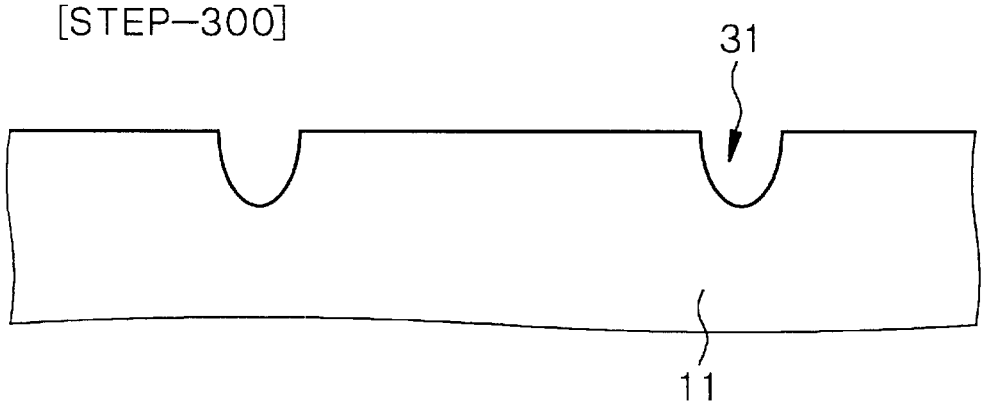
FIGS. 11A, 11B and 11C are schematic partial cross-sectional views of a first substrate, etc., for explaining the method for producing a first panel in the method for the production of an alternating current driven type plasma display device in Example 3 of the present invention.

First, a recess is formed in a portion of the first substrate that is interposed between regions where a pair of the facing first electrodes are to be formed (see FIG. 11A). The recess can be formed by a chemical method, such as a wet etching method or a dry etching method, whereby the recess 31 constituted of a trench or a blind hole can be obtained. Alternatively, the recess can be formed by a mechanical excavation method such as a dicing saw method or a mechanical grinding method such as a sand blasting method, whereby the recess 31 constituted of a trench can be obtained. Alternatively, the recess can be formed by a direct method in which the first substrate is formed, for example, by a hot press method, whereby the recess constituted of a trench or the recess constituted of a blind hole can be obtained. The trench is formed to have a width of $4\times10^{-5}$ m (40 $\mu$m) in an upper portion thereof and a depth of $8\times10^{-5}$ m (80 $\mu$m). In the drawings, it is shown that the bottom of the recess 31 is rounded. Under some forming methods or conditions, the recess 31 has a rectangular cross-sectional form when cut with the YZ plane.

[Step-310]

Figure 11B:
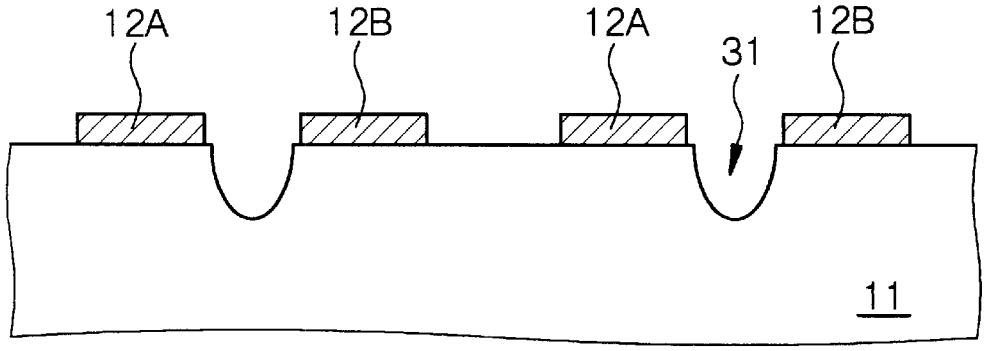
Figure 11C:
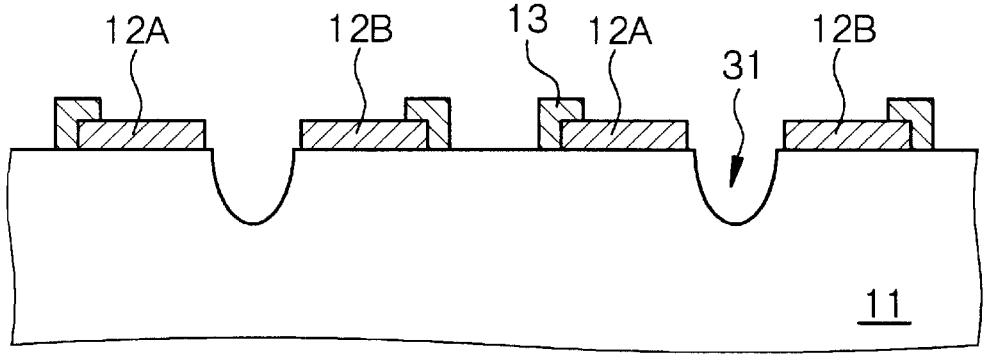

Then, the patterned first electrodes 12A and 12B are formed on the surface of the first substrate 11 near the recess 31 (see FIG. 11B). Specifically, the patterned first electrodes 12A and 12B can be formed, for example, by a lift-off method. That is, a resist layer is formed on the substratum, a portion of the resist layer where the first electrodes 12A and 12B are to be formed on the first substrate 11 is selectively removed by lithography, and then, a conductive material layer composed of ITO is formed on the entire surface, for example, by a sputtering method. Then, the resist layer and the conductive material layer thereon are removed. Then, the bus electrode 13 composed of a Cr/Cu/Cr stacked film can be formed, for example, by a lift-off method (see FIG. 11C).

[Step-320]

A protective layer 14 is formed on the first electrode group and the first substrate 11 including the inside of the recess 31 in the same manner as in [Step-120] in Example 1. The trench has a spatial width of approximately $2\times10^{-5}$ m (20 $\mu$m).

While the present invention has been explained hereinabove with reference to examples, the present invention shall not be limited to these examples. Particulars of the constitution of the plasma display device and the component materials and the method for the production of an alternating current driven type plasma display device can be properly selected and combined. A second electrode group constituted of a plurality of second electrodes may be formed on the first substrate. That is, there may be employed a constitution in which the second electrodes are formed on an insulating layer formed on the protective layer 14 and the extending direction of the second electrodes and the extending direction of the first electrodes make an predetermined angle (for example, 90°).

In the present invention, since the recess is formed in the first substrate between a pair of the first electrodes that are caused to discharge, the discharge space can be increased in volume. As a result, metastable particles required for starting and sustaining discharge can be increased in number, there is no increase in the discharge starting voltage and the discharge sustain voltage, and no decrease in efficiency is caused. Further, since the path of leak current flowing between a pair of the first electrodes is increased in length due to the presence of the recess, the leak current flows to a lesser degree, and dielectric breakdown or abnormal discharge takes place to a less degree. Further, it does not require much to decrease the thickness of the separation walls 25, which serves to decrease damage the separation walls during fabrication, and the risk of optical crosstalk decreases. Further, since the discharge space increases in volume, secondary particles emitted from the protective layer do not adhere to the separation walls, and no decrease in efficiency is caused.

Further, the recess can be formed as a trench having a spatial width of less than $5\times10^{-5}$ m or a blind hole having a spatial diameter of less than $5\times10^{-5}$ m. In this case, the ratio of discharge based on cathode glow through the recess between a pair of the facing first electrodes can be increased, so that the discharge efficiency can be improved and that power consumption can be decreased.

What is claimed is:

1. An alternating current driven type plasma display device having;

(a) a first panel comprising a first substrate; a first electrode group constituted of a plurality of first electrodes formed on the first substrate; and a protective layer formed on the first electrode group and on the first substrate, and (b) a second panel comprising a second substrate; fluorescence layers formed on or above the second substrate; and separation walls which extend in the direction making a predetermined angle with the extending direction of the first electrodes and each of which is formed between one fluorescence layer and another neighboring fluorescence layer, wherein discharge is caused between each pair of the first electrodes facing each other, and a recess is formed in the first substrate between each pair of the facing first electrodes.

2. The plasma display device according to claim 1, wherein the recess is a trench.

3. The plasma display device according to claim 2, wherein a spatial width of the trench is less than $5\times10^{-5}$ m.

4. The plasma display device according to claim 1, wherein the recess is a blind hole formed in a region of the first substrate positioned between a pair of the separation walls.

5. The plasma display device according to claim 4, wherein a spatial diameter of the blind hole is less than $5\times10^{-5}$ m.

6. A method for the production of an alternating current driven type plasma display device, said plasma display device having;

(a) a first panel comprising a first substrate; a first electrode group constituted of a plurality of first electrodes formed on the first substrate; and a protective layer formed on the first electrode group and on the first substrate, and (b) a second panel comprising a second substrate; fluorescence layers formed on or above the second substrate; and separation walls which extend in the direction making a predetermined angle with the extending direction of the first electrodes and each of which is formed between one fluorescence layer and another neighboring fluorescence layer, wherein discharge is caused between each pair of the first electrodes facing each other, said method including the steps of;

(A) forming the patterned first electrodes on the first substrate, (B) forming a recess in the first substrate between each pair of the first electrodes facing each other, and (C) forming the protective layer on the first electrode group and on the first substrate including the inside of each recess, to fabricate the first panel.

7. The method according to claim 6, wherein the step (B) comprises the steps of forming a resist layer having an opening portion between a pair of the facing first electrodes on the entire surface, and then, etching the first substrate with using the resist layer as an etching mask.

8. The method according to claim 6, wherein the step (B) comprises the step of forming the recess in the first substrate between a pair of the facing first electrodes by a mechanical excavation method or a mechanical grinding method.

9. A method for the production of an alternating current driven type plasma display device, said plasma display device having;

(a) a first panel comprising a first substrate; a first electrode group constituted of a plurality of first electrodes formed on the first substrate; and a protective layer formed on the first electrode group and on the first substrate, and (b) a second panel comprising a second substrate; fluorescence layers formed on or above the second substrate; and separation walls which extend in the direction making a predetermined angle with the extending direction of the first electrodes and each of which is formed between one fluorescence layer and another neighboring fluorescence layer, wherein discharge is caused between each pair of the first electrodes facing each other, said method including the steps of;

(A) forming a conductive material layer on the first substrate, (B) patterning the conductive material layer to form the first electrodes, and further, forming a recess in the first substrate between a pair of the first electrodes facing each other, and (C) forming the protective layer on the first electrode group and on the first substrate including the inside of the recess, to fabricate the first panel.

10. The method according to claim 9, wherein the step (B) comprises the steps of forming a patterned resist layer on the conductive material layer, then etching the conductive material layer with using the resist layer as an etching mask, and further, etching the first substrate.

11. The method according to claim 9, wherein the step (B) comprises the step of patterning the conductive material layer and further forming the recess in the first substrate by a mechanical excavation method or a mechanical grinding method.

12. A method for the production of an alternating current driven type plasma display device, said plasma display device having;

(a) a first panel comprising a first substrate; a first electrode group constituted of a plurality of first electrodes formed on the first substrate; and a protective layer formed on the first electrode group and on the first substrate, and (b) a second panel comprising a second substrate; fluorescence layers formed on or above the second substrate; and separation walls which extend in the direction making a predetermined angle with the extending direction of the first electrodes and each of which is formed between one fluorescence layer and another neighboring fluorescence layer, wherein discharge is caused between each pair of the first electrodes facing each other, said method including the steps of;

(A) forming a recess in a portion of the first substrate between regions of the first substrate on which regions a pair of the facing first electrodes are to be formed, (B) forming the patterned first electrodes on the surface of the first substrate and in the vicinity of the recess, and (C) forming the protective layer on the first electrode group and on the first substrate including the inside of the recess, to fabricate the first panel.

13. The method according to claim 12, wherein the step (A) comprises the step of forming the recess in the first substrate by any one of a mechanical method, a chemical method and a direct method.

* * * * *